US007213513B2

(12) United States Patent
Christel et al.

(10) Patent No.: US 7,213,513 B2
(45) Date of Patent: May 8, 2007

(54) PRINTING GROUP PERTAINING TO A PRINTING MACHINE HAVING A LINEARLY DISPLACEABLE TRANSFER CYLINDER

(75) Inventors: Ralf Christel, Aschbach (DE); Oliver Frank Hahn, Veitshöchheim (DE); Karl Erich Albert Schaschek, Thüngen (DE); Georg Schneider, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/473,147

(22) PCT Filed: Apr. 6, 2002

(86) PCT No.: PCT/DE02/01266

§ 371 (c)(1),
(2), (4) Date: Jan. 2, 2004

(87) PCT Pub. No.: WO02/081218

PCT Pub. Date: Oct. 17, 2002

(65) Prior Publication Data

US 2004/0107849 A1 Jun. 10, 2004

(30) Foreign Application Priority Data

Apr. 9, 2001 (DE) ..... 101 17 703
Aug. 3, 2001 (DE) ..... 101 38 221

(51) Int. Cl.
*B41F 9/00* (2006.01)

(52) U.S. Cl. ..... 101/218; 101/143; 101/247; 101/485

(58) Field of Classification Search ..... 101/139, 101/143, 216, 247, 248, 485, 218
See application file for complete search history.

(56) References Cited

U.S. PATENT DOCUMENTS

| | | | | |
|---|---|---|---|---|
| 4,125,073 | A | 11/1978 | Bain | |
| 4,233,898 | A | 11/1980 | Dahlgren | |
| 4,598,640 | A | 7/1986 | Nawrath | |
| 4,815,377 | A | 3/1989 | Skiera | |
| 5,005,475 | A | 4/1991 | Knauer | |
| 5,651,314 | A * | 7/1997 | Gentle | 101/248 |
| 5,692,439 | A | 12/1997 | Wech | |
| 5,868,071 | A * | 2/1999 | Niemiro et al. | 101/218 |
| 5,950,537 | A * | 9/1999 | Petersen et al. | 101/216 |

(Continued)

FOREIGN PATENT DOCUMENTS

| | | |
|---|---|---|
| CH | 345906 | 6/1960 |

(Continued)

*Primary Examiner*—Daniel J. Colilla
*Assistant Examiner*—Kevin D. Williams
(74) *Attorney, Agent, or Firm*—Jones, Tullar & Cooper, PC

(57) ABSTRACT

A printing group of a printing machine is comprised of at least two cylinders, a forme cylinder and a transfer cylinder. The transfer cylinder can be moved between a print-on position and a print-off position along a linear adjustment path. Both of the cylinders in the printing group can be driven mechanically to rotate independently of another printing group. This rotation is accomplished by at least one drive motor which is fixed on a frame of the printing machine.

50 Claims, 11 Drawing Sheets

U.S. PATENT DOCUMENTS

| | | | | |
|---|---|---|---|---|
| 5,979,317 | A | 11/1999 | Singler | |
| 6,019,039 | A * | 2/2000 | Knauer et al. | 101/218 |
| 6,213,016 | B1 * | 4/2001 | Tsunashima | 101/218 |
| 6,216,592 | B1 * | 4/2001 | Knauer et al. | 101/247 |
| 6,293,194 | B1 * | 9/2001 | Vrotacoe | 101/248 |
| 6,314,882 | B1 * | 11/2001 | Petersen | 101/219 |
| 6,334,389 | B1 | 1/2002 | Fischer | |
| 6,397,743 | B1 | 6/2002 | Dauer et al. | |
| 6,408,747 | B2 | 6/2002 | Koppelkamm et al. | |
| 6,408,748 | B1 | 6/2002 | Hajek | |
| 6,494,135 | B1 * | 12/2002 | Gottling et al. | 101/213 |
| 6,494,138 | B1 | 12/2002 | Gottling et al. | |
| 6,539,857 | B1 | 4/2003 | Weschenfelder | |
| 6,543,352 | B1 * | 4/2003 | Dilling et al. | 101/220 |
| 6,557,467 | B1 * | 5/2003 | Dilling et al. | 101/220 |
| 6,681,694 | B2 | 1/2004 | Schneider et al. | |
| 6,732,650 | B2 | 5/2004 | Rauh | |
| 6,834,585 | B2 | 12/2004 | Hahn | |
| 7,032,510 | B2 * | 4/2006 | Christel et al. | 101/216 |
| 7,140,295 | B2 * | 11/2006 | Christel et al. | 101/144 |
| 2001/0035104 | A1 * | 11/2001 | Gottling et al. | 101/248 |
| 2002/0178946 | A1 | 12/2002 | Hahn | |

FOREIGN PATENT DOCUMENTS

| | | | |
|---|---|---|---|
| DE | 34 12 812 | C1 | 6/1985 |
| DE | 3441175 | A1 * | 5/1986 |
| DE | 38 19 159 | A1 | 1/1989 |
| DE | 91 09 833.5 | U1 | 10/1991 |
| DE | 44 15 711 | A1 | 11/1995 |
| DE | 44 19 217 | A1 | 12/1995 |
| DE | 198 15 294 | A1 | 10/1998 |
| DE | 197 24 765 | A1 | 12/1998 |
| DE | 198 03 809 | A1 | 8/1999 |
| DE | 19803809 | A1 * | 8/1999 |
| DE | 199 37 796 | A1 | 2/2001 |
| DE | 199 61 574 | A1 | 7/2001 |
| EP | 0 862 999 | A2 | 9/1998 |
| EP | 1 075 945 | A1 | 2/2001 |
| FR | 1257397 | | 3/1961 |
| GB | 1096950 | | 12/1967 |
| GB | 1476707 | | 6/1977 |
| JP | 36-16405 | | 6/1936 |
| JP | 51-24309 | | 2/1976 |
| JP | 55-39865 | | 9/1978 |
| JP | 57-98361 | | 6/1982 |
| JP | 57-107842 | | 7/1982 |
| JP | 57131561 | A | 8/1982 |
| JP | 60-225799 | | 11/1985 |
| JP | 62-144632 | | 9/1987 |
| JP | 2086445 | | 3/1990 |
| JP | 2-196658 | | 8/1990 |
| JP | 2-245333 | | 10/1990 |
| JP | 6-278264 | | 10/1994 |
| JP | 7195655 | | 8/1995 |
| JP | 10071694 | A | 3/1998 |
| JP | 10076629 | | 3/1998 |
| JP | 2002254598 | | 9/2002 |
| WO | WO 99/30906 | | 6/1999 |
| WO | WO 00/06385 | | 7/1999 |
| WO | WO 01/45946 | A1 | 6/2001 |
| WO | WO 01/83215 | A1 | 11/2001 |

* cited by examiner

PRINTING GROUP PERTAINING TO A PRINTING MACHINE HAVING A LINEARLY DISPLACEABLE TRANSFER CYLINDER

FIELD OF THE INVENTION

The present invention is directed to a printing group of a printing press with a linearly movable transfer cylinder.

BACKGROUND OF THE INVENTION

A printing group is known from DE 198 03 809 A1. A forme cylinder has one printing plate in the circumferential direction on its circumference, and several printing plates in the longitudinal direction. A transfer cylinder working together with the forme cylinder has double the circumference and is embodied for having one printing blanket in the circumferential direction and two in the longitudinal direction which two printing blankets, however, are arranged offset from each other in the circumferential direction.

JP 10-071 694 discloses printing group cylinders with four grooves arranged next to each other and offset in the circumferential direction in respect to each other. The printing group cylinders have a so-called double circumference.

An arrangement for a joint-free printing press is known from CH 345 906. The joints of four dressings which are arranged next to each other on transfer cylinders of double circumference, and the joints of four dressings which are arranged next to each other on a forme cylinder, are arranged offset from each other.

A double printing group is known from DE 198 15 294 A1, wherein the rotating shafts of the printing group cylinders are arranged on one level. The cylinders have four times the width of a newspaper page, double width and a circumference of one height of a newspaper page. The transfer cylinders have endless sleeves, which can be laterally exchanged through openings in the lateral wall.

Printing group cylinders of single circumference are known from U.S. Pat. No. 4,125,073, which have an oscillation damper. In the case of wider printing presses, the forme cylinder has a double circumference and two printing plates arranged one behind the other. The grooves, which are arranged in the longitudinal direction next to each other and which receive the printing plates, are additionally offset in respect to each other in the circumferential direction.

A double printing group is known from DE 44 15 711 A1. For the purpose of improving the print quality, a plane which extends perpendicularly to the paper web is inclined by approximately 0° to 10° in relation to a plane connecting the two rotating shafts of the transfer cylinders.

JP 57-131 561 discloses a double printing group wherein the shafts of the printing group cylinders are arranged in one plane. The phases of the printing group cylinders are arranged with each other in such a way that grooves for fastening the dressings roll off on each other, and simultaneously on the two printing groups which are working together.

A double printing group is also disclosed in DE 34 12 812 C1 and in DE 38 19 159 A1. In each of these disclosures, a pair of cylinder shafts are arranged in essentially a common plane in a printing position during web printing, which plane extends inclined in relation to the web to be imprinted. Within a short distance of that printing position, the placement of the transfer cylinders against, or away from other cylinders takes place along an almost straight movement direction by the use of double eccentric cams.

EP 0 862 999 A2 discloses a double printing group with two transfer cylinders which are working together and which are seated in eccentric, or double eccentric bushings, for the purpose of being placed against or away from other cylinders. In another embodiment, the two transfer cylinders are seated on levers, which are seated eccentrically in respect to the forme cylinder shaft and are pivotable.

A double printing group, in which the shafts of the printing group cylinders are arranged in one plane, is known from EP 1 075 945 A1. Several printing group cylinders are seated in carriages and are embodied so that their distance from each other can be changed by the use of guide elements arranged in a support wall for the purpose of being placed against or away from other cylinders.

Printing group cylinders are known from DE 199 37 796 A1, which can be moved along a linear actuation path in order to place them against or away from each other. A drive motor, which is moved simultaneously with the cylinder, is assigned to each cylinder. Movement takes place in a direction extending parallel in respect to a common plane of the printing group cylinders.

For the purpose of the transfer cylinders in U.S. Pat. No. 5,868,071 being placed against or away from other cylinders, these transfer cylinders are seated in carriages. These carriages are linearly displaceable in the lateral frame along parallel movement directions in linear guide elements having linear bearings.

SUMMARY OF THE INVENTION

The object of the present invention is directed to providing a printing group of a printing press with a linearly movable transfer cylinder.

In accordance with the present invention, this object is attained by providing the printing group of the printing press having at least a forme cylinder and a transfer cylinder. The transfer cylinder can be placed in either a print-on or a print-off position along a linear actuating path, with respect to a counter-pressure cylinder. The shafts of the several cylinders are located in a common plane when the transfer cylinder is in its print-on position.

The advantages which can be gained by the present invention lie, in particular, in that a printing press is provided which is constructed in a compact, low-oscillating and rugged manner, provides a large production variety and requires a comparatively low production and maintenance outlay.

Minimizing the number of parts which must be designed to be movable for normal operations and during setup, for example omitting the movement of all cylinders, frame walls, bearings etc., assures a rugged and cost-effective construction.

The cylinders support each other by the linear arrangement of the printing group cylinders, i.e. by the arrangement of the rotating shafts of the printing group cylinders in the print-on position in substantially one plane. This prevents relative sagging of the cylinders. Even a compensation of the bending static line of the forme and of the transfer cylinders, in respect to each other, can be achieved.

Since the dressings on the cylinders are not secured in grooves extending continuously over the length of the cylinders, but instead in grooves which are offset in respect to each other in the circumferential direction, a groove beating, in the course of the passage of the groove during the roll-off of two cylinders on each other, is considerably reduced. In an advantageous embodiment, in the case of two grooves arranged next to each other in the longitudinal direction, the grooves are arranged offset by 180° from each other.

The arrangement of the printing group cylinders and their grooves in such a way that the grooves of each cylinder, which are offset in respect to each other, roll off in the area of the opposite, offset groove of the cylinder working together with it, is particularly advantageous. A compensation of the dynamic forces can occur in this way. At a fixed offset angle of 180°, and with a linear arrangement of the cylinders, destructive interference occurs at all production rates, i.e. angular speeds, without an offset angle of the grooves needing to be changed as a function of the number of revolutions or the frequency.

The arrangement of printing group cylinders of single circumference is particularly advantageous for printed products of a small and/or of a variable number of pages and/or for print shops with restricted space availability. In comparison with the production of the same product on a printing press of double circumference (without assembling), no "double" plate change is required. In contrast to a printing press of double circumference, during assembling operations it becomes possible to create a page jump of two pages and in this way to provide increased flexibility in the printed product.

The type of construction, with all of the printing groups cylinders being of a single circumference, permits a much more compact and easier construction, in comparison with printing groups having one or several cylinders of double circumference. Also, rubber blankets, which would have to be replaced in case of damage are smaller and therefore more cost-effective.

The use of printing blankets and printing plates makes it possible to seat the cylinders stably at both ends, which makes possible a simple, rugged and cost-effective construction of the frame receiving the printing group cylinders.

Also, in view of a rugged and simple construction, it is advantageous if only the transfer cylinders need to be moved for bringing the printing group into or out of contact with others. Although the forme cylinders can be movably seated for adjusting the distance to the associated transfer cylinder as well as to a possible inking system and, if provided, a dampening system, the placement against or away from each other of the transfer cylinders and the associated forme cylinders takes place in an advantageous manner only by a movement of the transfer cylinders.

The linear arrangement of the cylinders is made possible by a specially selected movement in the area of the printing position. At the same time, devices for movement into and out of contact, or movements into and out of contact of the forme cylinders are avoided. This, too, contributes to a rugged and simple construction.

In one embodiment, the transfer cylinders are seated in carriages, for example, in linear guide devices, or on the lateral frame, which makes possible a movement which is substantially perpendicular in respect to the plane of the axes of the cylinders. If the guide devices are arranged in specially designed inserts on the lateral frame, the journals are shortened and make possible a simple construction of an encapsulated lubricant chamber. A special arrangement of the movement direction makes possible the rapid and assured separation between the forme and counter-pressure cylinders, as well as from the web.

By the dressings being embodied in the form of so-called metallic printing blankets on the transfer cylinders, the effective groove width is reduced, because of which, an excitation of oscillations is further reduced in an advantageous manner. The non-printing area on the cylinders, i.e. the "white edge" on the product, as well as paper waste, are also reduced.

An embodiment of the printing group with cylinders of single circumference, and the arrangement in one plane, with offset grooves which, however, alternatingly roll off on each other, and with dressings which are embodied as metallic printing blankets on the transfer cylinders, is particularly advantageous.

Cylinders, or rollers, of printing groups must be moved away from each other, out of an operating state designated as "print on", i.e. a print-on position, and then back into contact with each other, particularly for washing, changing of dressings, and the like. The radial movement of the rollers required for this also contains a movement component in a tangential direction, whose size is a function of the structural design; i.e. the design of the eccentric cam, lever, linear guide device, as well as their angle in respect to the nip point of the actuating device. If a speed difference is created on the active jacket surfaces at the nip point because of the actuation in relation to the operational state, this implies, because of the surface friction of the roller materials used, a tangential frictional force component which is directed opposite to the actuating movement. Therefore, the actuating movement is slowed by this, or its speed is limited. This is important in particular with printing group cylinders in case of so-called "windings", since there large frictional forces also result from the high pressures which are also occurring.

It is therefore advantageous, in a method for bringing cylinders into and out of contact with each other, that a relative tangential speed in the area near the contact, i.e. in the area of the nip point, of two cylinders or rollers working together, is reduced, correlated with the movement, by the intentional rotation, or turning, of at least one of the affected cylinders or rollers. Besides a reduction of the slowing of the actuation, an unnecessarily high load, such as caused by friction or deformation on the dressings and/or the jacket surfaces of the involved cylinders or rollers, is prevented.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
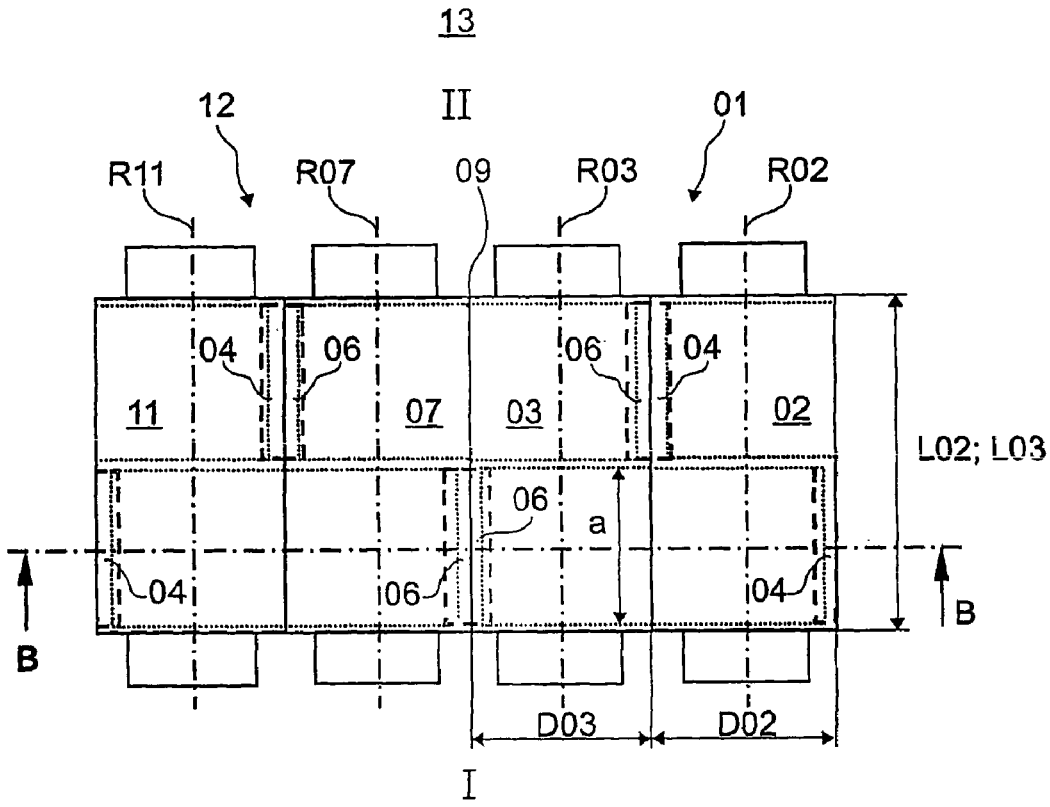
FIG. 1, a schematic representation of a double printing group.
Figure 5:
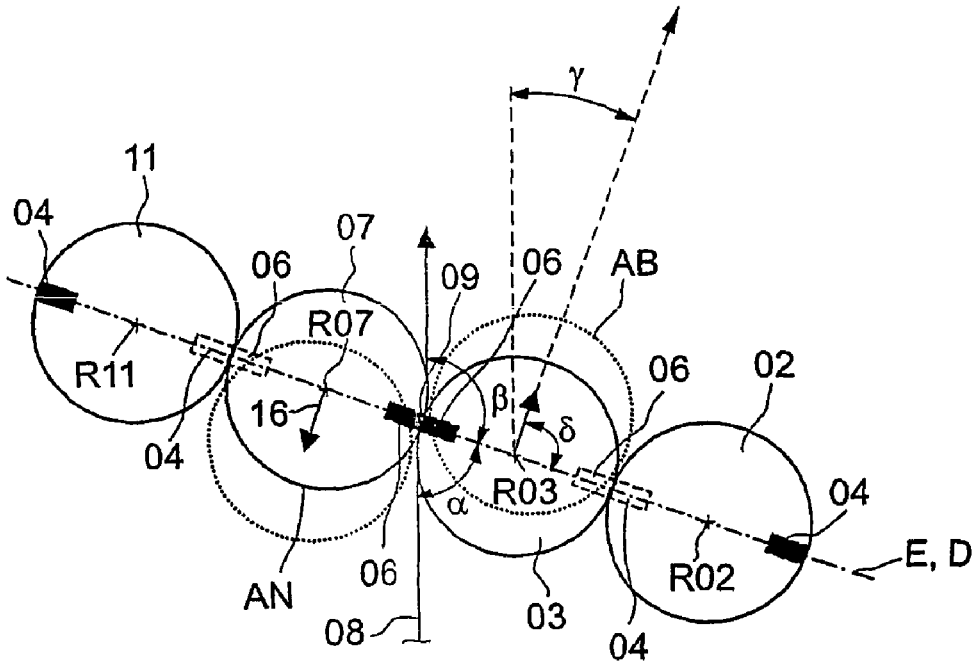

Referring initially to FIG. 1, there may be seen a first preferred embodiment of a printing group of a printing press in accordance with the present invention. A first printing group 01 of a printing press, in particular a rotary printing press, has a first cylinder 02, for example a forme cylinder 02, and an associated second cylinder 03, for example a transfer cylinder 03. Their rotating shafts R02, R03 define a plane E in a print-on position AN, as seen in FIG. 5.

On their circumferences, the forme cylinder 02 and the transfer cylinder 03 each have at least one interference in the circumferential direction on the jacket surface, for example a disruption 04, 06 in the jacket surface which is active during roll-off. This disruption 04, 06, which is also shown in FIG. 5, can be a joint between leading and trailing ends of one or several dressings, which are arranged on the circumference, for example by use of a magnetic force or by material-to-material contact. However, as represented in what follows in the preferred embodiments, these can also be grooves 04, 06, or slits 04, 06, which receive ends of dressings. The interferences, called grooves 04, 06 in what follows, are equivalent with other interruptions 04, 06 on the active jacket surface, i.e. the outward pointing face of the cylinders 02, 03 provided with dressings.

Each of the forme cylinders 02 and transfer cylinders 03 has at least two grooves 04, 06, or interruptions 04, 06. These two grooves 04, 06 are respectively arranged one behind the other in the longitudinal direction of the cylinders 02, 03, and are offset in respect to each other in the circumferential direction.

If the cylinders 02, 03 only have a length L02, L03, which substantially corresponds to two widths of a newspaper page, only two grooves 04 and 06 are provided, which are offset in respect to each other in the circumferential direction and are arranged one behind the other in the longitudinal direction.

The grooves 04, 06 are arranged on the two cylinders 02, 03 in such a way that, in the course of a rotation of the two cylinders 02, 03, they roll off on respectively one of the grooves 06, 04 of the other cylinder 03, 04. The offset of the grooves 04, 06 of each cylinder 02, 03 in the circumferential direction is preferably approximately 180°. Therefore, after respectively one 180° rotation of the cylinders 02, 03, at least one pair of grooves 04, 06 rolls off on each other, while on a longitudinal section "a" of the cylinders 02, 03, as seen in FIG. 1, the cylinders 02, 03 roll off unimpeded on each other.

Figure 2:
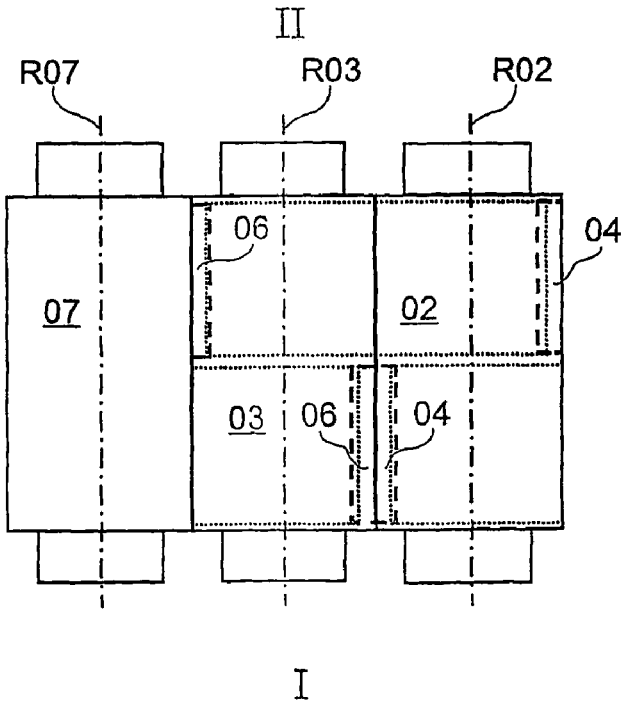
FIG. 2, a schematic representation of a three-cylinder offset printing group, FIG. 3, a schematic representation of a double-wide double printing group, FIG. 4, a schematic representation of a double-wide double printing group, which is highly symmetrical, FIG. 5, a schematic representation of a double printing group in a section taken along line B—B in FIG. 1, and with a linear actuating path, FIG. 6, a schematic representation of a non-linear double printing group with linear actuating paths, FIG. 7, a schematic representation of an H-printing group with a linear actuating path, FIG. 8, a side view of a first embodiment of a linear guide device for transfer cylinders, FIG. 9, a cross-section through the linear guide device in FIG. 8, FIG. 10, a side elevation view of a second embodiment of a linear guide device for transfer cylinders, FIG. 11, a section through the linear guide device shown in FIG. 10, FIG. 12, a schematic end view of a double printing group with cylinders of differing circumference, FIG. 13, the coverage of a forme cylinder with four newspaper pages, FIG. 14, the coverage of a forme cylinder with eight tabloid pages, FIG. 15, the coverage of a forme cylinder with sixteen vertical pages in book format, and in FIG. 16, the coverage of a forme cylinder with sixteen horizontal pages in book format.

The transfer cylinder 03 of the first printing group 01 forms a printing position 09, together with a third cylinder 07, on a web 08, for example a web 08 of material to be imprinted. This third cylinder 07 can be embodied as a second transfer cylinder 07, as shown in FIG. 1, or as a counter-pressure cylinder 07, as shown in FIG. 2, for example as a steel cylinder or a satellite cylinder 07. In the print-on position AN, the rotating shafts R03 and R07 of the cylinders 03, 07 forming the printing position 09 define a plane D. See, for example, FIG. 6 or FIG. 13.

Figure 12:
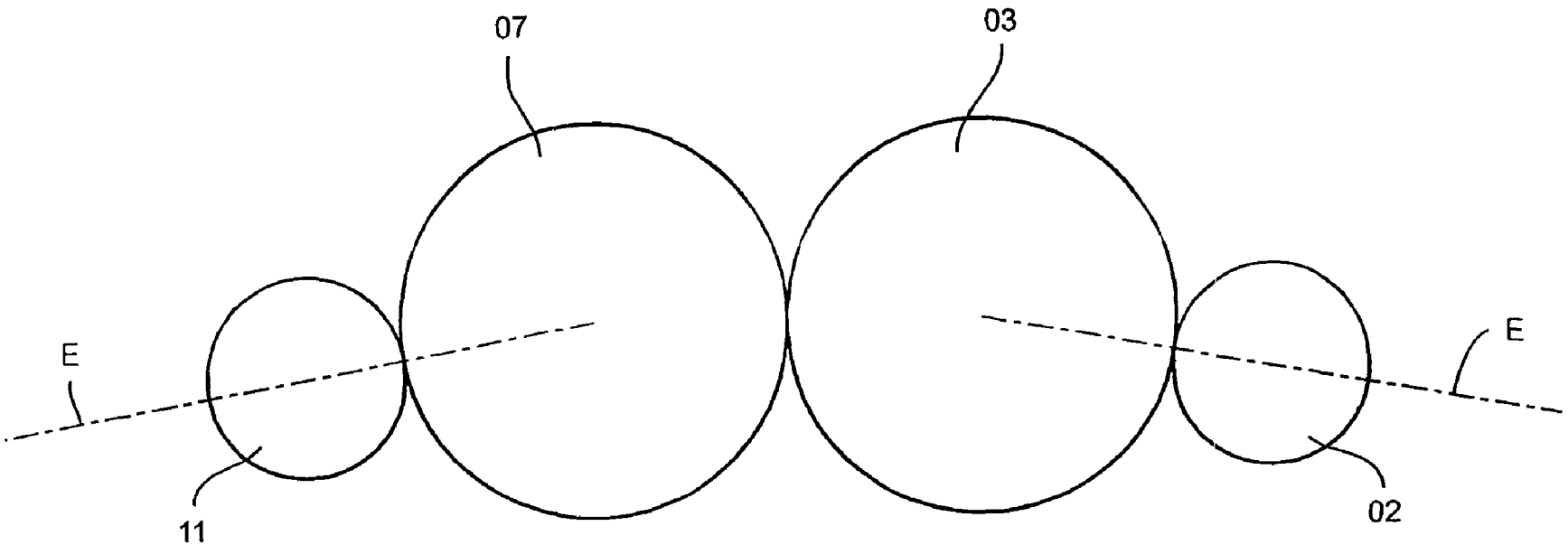

In the embodiment of FIG. 5, in the print-on position AN the rotating shafts R02, R03, R07 of the three cylinders 02, 03, 07 working together are substantially located in a common plane E which, in this case, coincides with the plane D, and which planes D and E extend parallel with each other, as seen in FIGS. 5, 12. If the satellite cylinder 07 has two printing positions on its circumference, a second printing group, not represented, is preferably also arranged in the common plane E. However, it can also define a plane E of its own, which is also different from the plane D associated with it.

As represented in the preferred embodiment in FIG. 1, the third cylinder 07, embodied as the second transfer cylinder 07, works together with a fourth cylinder 11, in particular a second forme cylinder 11 with an rotating shaft R11 and constitutes a second printing group 12. The two separate printing groups 01, 12 constitute a combined printing group 13, a so-called double printing group 13, which imprints both sides of the web 08 simultaneously.

Figure 6:
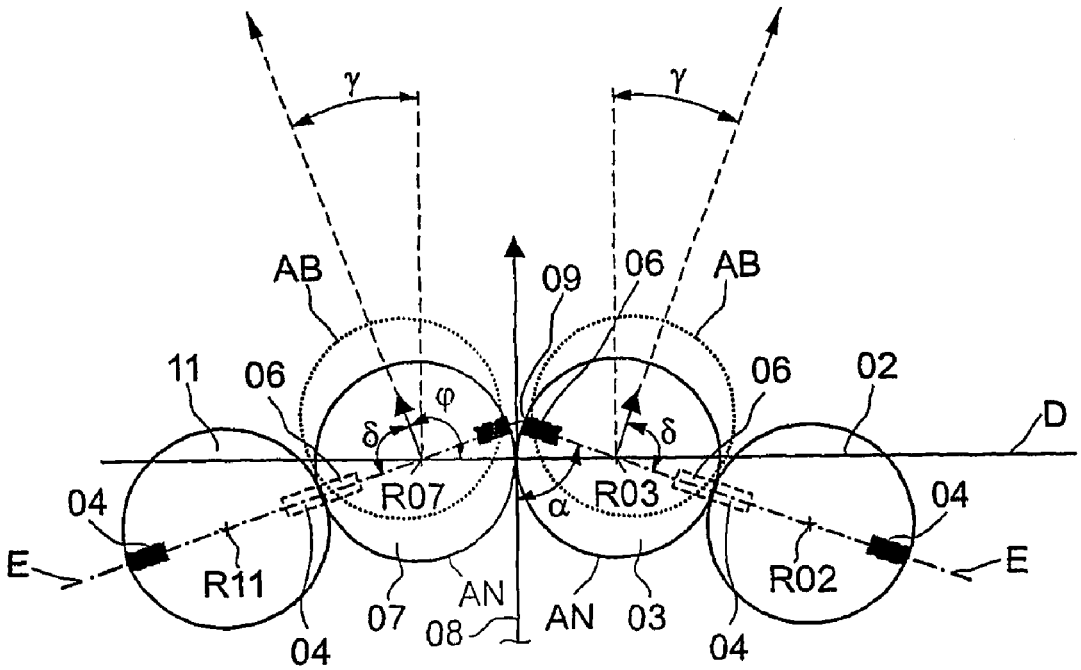
Figure 13:
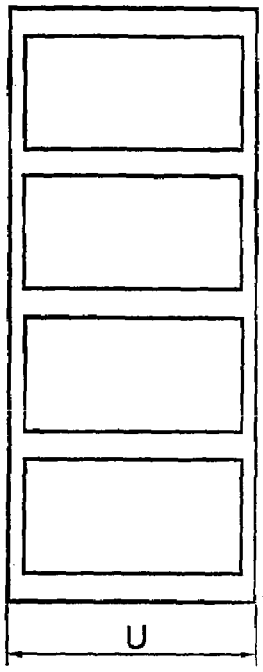

As seen in FIG. 5, during printing, i.e. in the print-on position AN, all rotating shafts R02, R03, R07, R11 of the four cylinders 02, 03, 07, 11 are located in the common plane E or D and extend parallel with each other. FIGS. 6 and 13 show a corresponding printing group 13, wherein respective pairs of forme and transfer cylinders 02, 03, 11, 07 form one plane E, and the transfer cylinders 03, 07 form the plane D, which differs from the plane E.

In the case of the double printing group 13, shown in FIG. 1, the cylinders 07, 11 of the second printing group 12 have grooves 04, 06 with the properties regarding the number and offset in respect to each other already described above in connection with the first printing group 01. Now the grooves 04, 06 of the four cylinders 02, 03, 07, 11 are preferably arranged in such a way that respectively two grooves 04, 06 of two cylinders 02, 03, 07, 11 which work together roll off on each other.

In an advantageous embodiment, the forme cylinder 02 and the transfer cylinder 03 each have a length L02, L03, which corresponds to four or more widths of a printed page, for example a newspaper page, for example 1,100 to 1,800 mm, and in particular to 1,500 to 1,700 mm, and a diameter D02, D03, for example 130 to 200 mm, and in particular of 145 to 185 mm, whose circumference U substantially corresponds to the length of a newspaper page, "single circumference" in what follows. The device is also advantageous for other circumferences, wherein the ratio between the circumferences D02, D03 and the length L02, L03 of the cylinders 02, 03 is less than or equal to 0, 16, in particular less than 0, 12, or even less than or equal to 0, 08.

In an advantageous embodiment, each of the two cylinders 02, 03 has two grooves 04, 06, each of which extends continuously at least over a length corresponding to two widths of a newspaper page.

Figure 4:
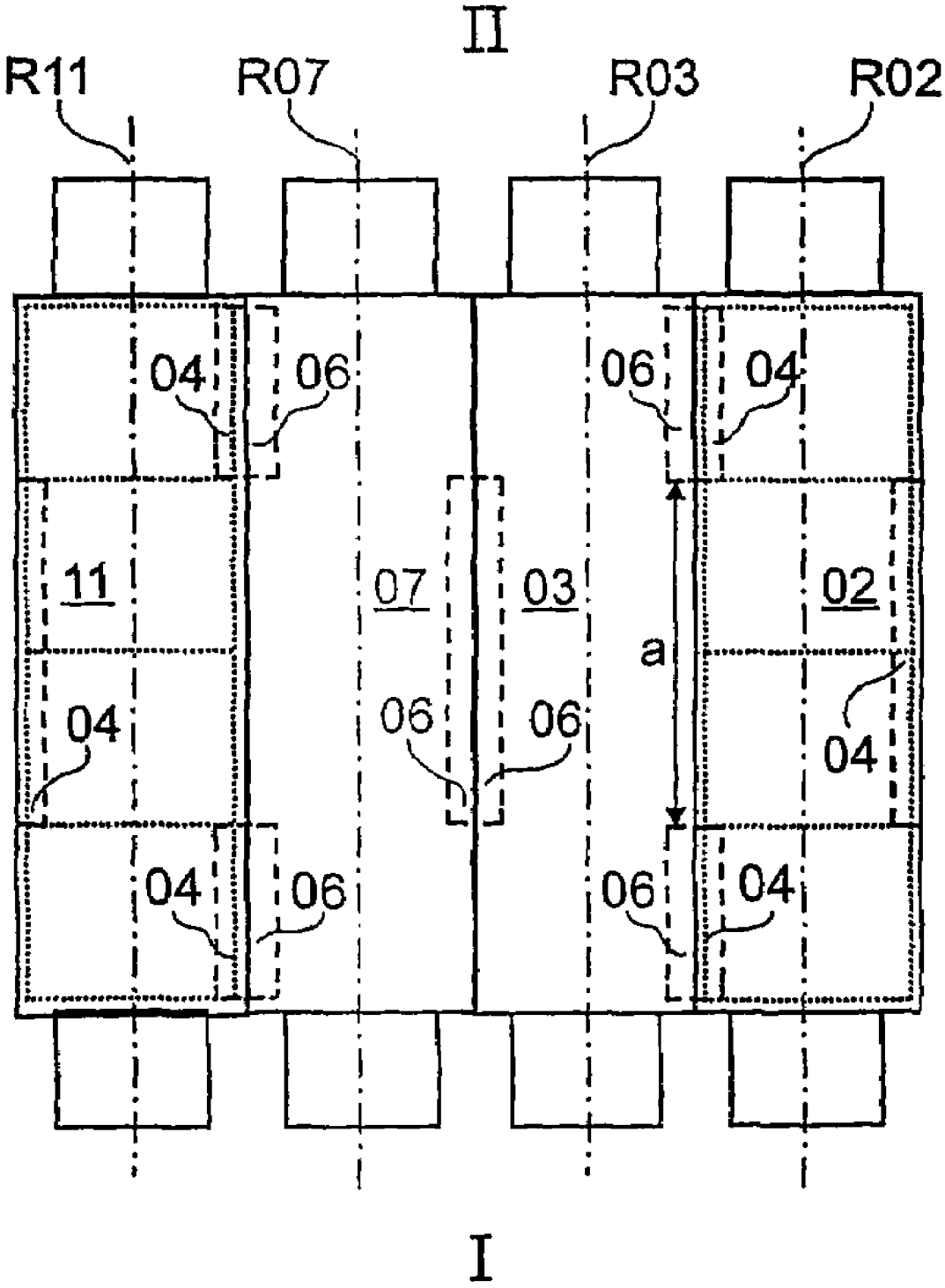

More than two grooves 04, 06 can be arranged per cylinder 02, 03. In this case, respectively two grooves 04, 06 arranged next to each other can be arranged aligned, or respectively alternatingly. However, for example with four grooves 04, 06, the two grooves 04, 06 adjoining the front ends of the cylinders 02, 03 can be arranged in a common alignment, and the two grooves 04, 06 located on the "inside" can be arranged in a common alignment, but offset in the circumferential direction in respect to the first mentioned ones, as depicted in FIG. 4.

If the interruptions 04, 06 are actually embodied as grooves 04, 06, or as slits 04, 06, the grooves 04, 06 schematically represented in FIGS. 1 to 4 can be slightly longer than the width, or twice the width of the printed page. Possibly two grooves 04, 06 adjoining each other in the longitudinal direction can also slightly overlap in the circumferential direction. This is not shown in detail in FIGS. 1 to 4, which are only schematic representations.

Figure 3:
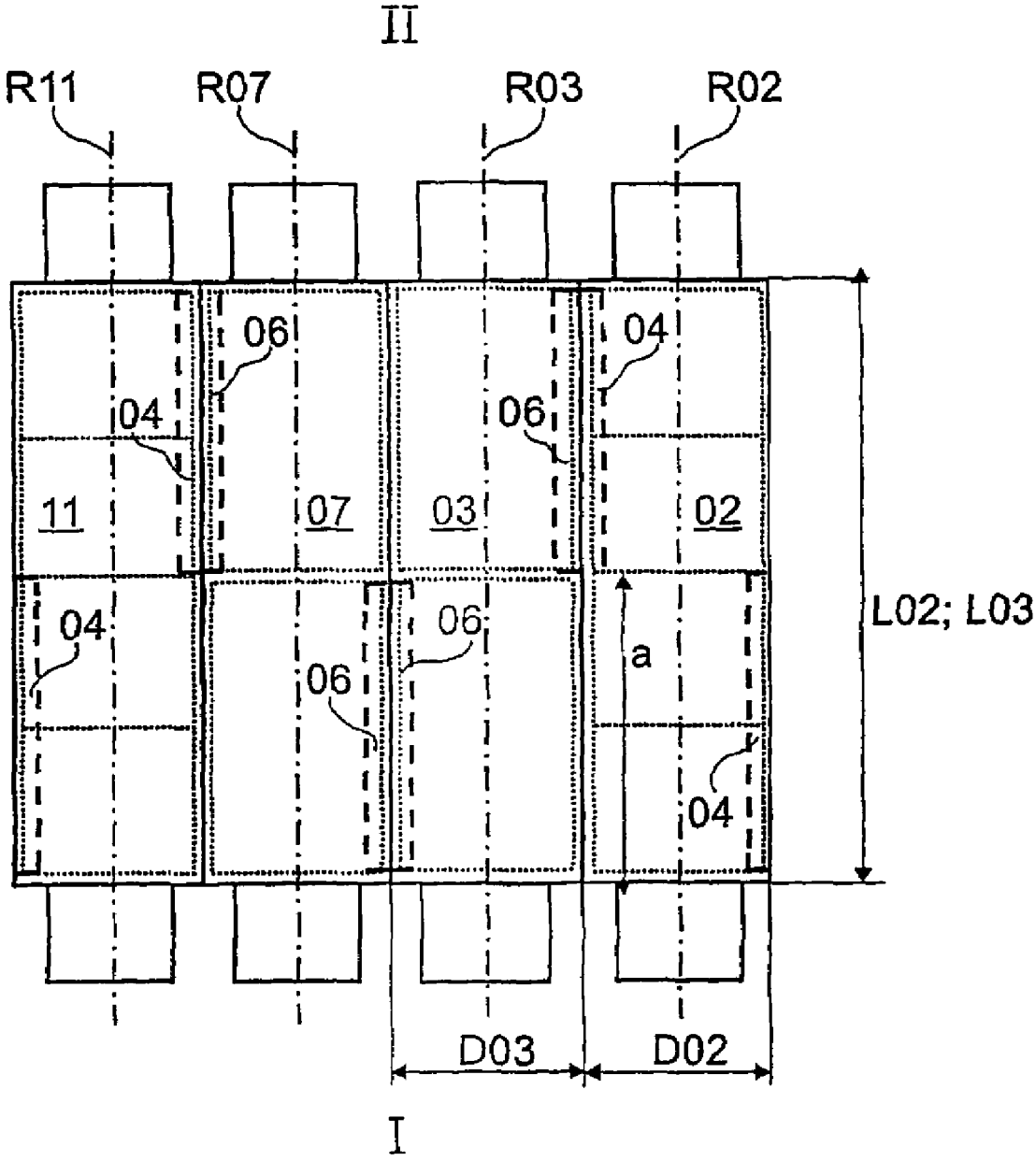

In view of the excitation, or the damping of oscillations caused by groove beating, it is particularly advantageous if the grooves 04, 06 on the respective cylinders 02, 03, 07, 11 are offset by 180° from each other. In this case, the grooves 04, 06 between the forme cylinders 02, 11 and the transfer cylinders 03, 07 of the two printing groups 01, 12 roll off simultaneously and in the area of the same section in the longitudinal direction of the cylinders 02, 03, 07, 11, in one stage of the cycle for example on the same side, for example a side 1, as seen in FIGS. 1, 3 and 4 of the double printing group 13, and in the other phase on a side 11 or, with more than two grooves 04, 06 per cylinder 02, 03, 07, 11, for example in the area of the center of the cylinders 02, 03, 07, 11.

The excitation of oscillations is considerably reduced by the offset arrangement of the grooves 04, 06 and the roll-off of all grooves 04, 06 in the described manner, and possibly also by the linear arrangement of the cylinders 02, 03, 07, 11 in one plane E. Because of the synchronous, and possibly symmetrical roll-off on the two printing groups 01, 12, a destructive interference with the excitation occurs which, with the selection of the offset by 180° of the grooves 04, 06 on the cylinders 02, 03, 07, 11, takes place independently of the number of revolutions of the cylinders 02, 03, 07, 11, or of the frequency.

If the interruptions 04, 06 are actually embodied as grooves 04, 06, in an advantageous embodiment they are embodied with a gap of only little width, for example less than or equal to 3 mm, in the area of a jacket surface of the forme cylinders 02, 11, or of the transfer cylinders 03, 07, which gap receives ends of one or several dressings, for example one or several rubber blankets on the transfer cylinder 03, 07, or ends of one or several dressings, for example one or several printing plates, on the forme cylinders 02, 11. The dressing on the transfer cylinder 03, 07 is preferably embodied as a so-called metallic printing blanket, which has an ink-conducting layer on a metallic base plate. In the case of the transfer cylinders 03, 07, the beveled edges of the dressings are secured by clamping and/or bracing devices, and in the case of forme cylinders 02, 11 by clamping devices, in the grooves 04, 06.

A single, continuous clamping and/or bracing device can be arranged in each one of the grooves 06 of the transfer cylinder 03 or, in case of grooves extending over several widths of newspaper pages, several clamping and/or bracing devices can be arranged one behind the other in the longitudinal direction. The grooves 04 of the forme cylinder 02, for example, also have a single, or several clamping devices.

A "minigap technology" is preferably employed in the grooves 04 of the forme cylinders 02, 11, as well as in the grooves 06 of the transfer cylinders 03, 07, wherein a leading dressing end is inserted into a groove with an inclined extending suspension edge, the dressing is wound on the cylinders 02, 03, 07, 11, the trailing end is also pushed into the groove 04, 06, and the ends are clamped, for example by use of a rotatable spindle or a pneumatic device, to prevent them from sliding out.

However, it is also possible to arrange a groove 04, 06 embodied as a narrow slit 04, 06 for the dressing on the forme cylinders 02, 11, as well as for the dressing, embodied as a metallic printing blanket, of the transfer cylinders 03, 07, which receives the ends of the dressings. In this case, the plate or blanket ends are secured in the slit 04, 06 by their shaping and/or by the geometry of the slit 04, 06.

For example, in an advantageous embodiment as depicted in FIG. 3, the transfer cylinders 03, 07 have only two dressings, which are offset by 180° from each other in the circumferential direction, each of which dressings has at least a width corresponding to two widths of a newspaper page. In this case, the dressings, or the grooves 04 of the forme cylinders 02, 11, extending complementary thereto must have either, as represented, two continuous grooves 04, each of the length of two widths of a newspaper page, or grooves 04 which adjoin in pairs and are arranged aligned, each of the length of two widths of a newspaper page. In the first case, in an advantageous embodiment, each interruption 04 of the forme cylinder 02, 11 actually embodied as a groove 04 which has two clamping devices, each of a length substantially corresponding to the width of a newspaper page.

In an advantageous embodiment, the forme cylinders 02, 11 are covered with four flexible dressings, which adjoin each other in the longitudinal direction of the forme cylinders 02, 11 and which have a length of slightly greater than the length of a printed image of a newspaper page in the circumferential direction, and in the longitudinal direction have a width of approximately one newspaper page. With the arrangement of continuous grooves 04 and with only one clamping device per groove 04, 06, which has a length of two widths of a newspaper page, it is also possible to apply dressings of a width of two newspaper pages, which dressings are so-called panoramic printing plates.

In connection with printing groups for which the need for a setup with panoramic printing plates can be excluded, an arrangement can also be of advantage in which the "outer" dressings, which respectively adjoin the side I and the side II, are aligned with each other, and the "inner" dressings are aligned with each other and are arranged offset by 180° from the first mentioned ones, as seen in FIG. 4. This highly symmetrical arrangement makes it additionally possible to minimize, or to prevent, the danger of an oscillation excitation in the plane E, which might result from the non-simultaneous passage of the grooves 04, 06 on the sides I and II. The alternating tensing and relaxation of the web 08 occurring alternatingly on the sides I and II, and oscillations of the web 08 caused thereby, can also be avoided by this.

In a further development, the above-mentioned arrangement of the interruptions 04, 06 on the respective cylinders 02, 03, 07, 11, as well as between the cylinders 02, 03, 07, 11, and the possibly linear arrangement of the cylinders 02, 03, 07, 11, can be applied in particular to cylinders of a length L02, L03 substantially corresponding to six times the width of a newspaper page. However, in this case, it can be advantageous to embody the transfer cylinders 03, 07 and/or the forme cylinders 02, 11 with a diameter D02, D03 which results in a circumference which substantially corresponds to double the length of a newspaper page.

In an advantageous embodiment, for a mechanically simple and rugged embodiment of the double printing group 13, the forme cylinders 02, 11 are arranged fixed with respect to their axes of rotation R02, R11. For bringing the printing groups 01, 12 in and out of contact, the transfer cylinders 03, 07 are embodied to be movable by shifting their rotating shafts R03, R07, and can each be simultaneously moved away from their associated forme cylinders 02, 11 and transfer cylinders 03, 07 working together with them, or can be placed against them. In this embodiment, only the transfer cylinders 03, 07 are moved in the course of normal operation of the printing press, while the forme cylinders 02, 11 remain in their fixed and possibly previously adjusted position. However, the forme cylinders 02, 11 can also be seated in appropriate devices, for example in eccentric or double eccentric bushings, in linear guide devices or on levers, for adjustment, if necessary.

Figure 7:
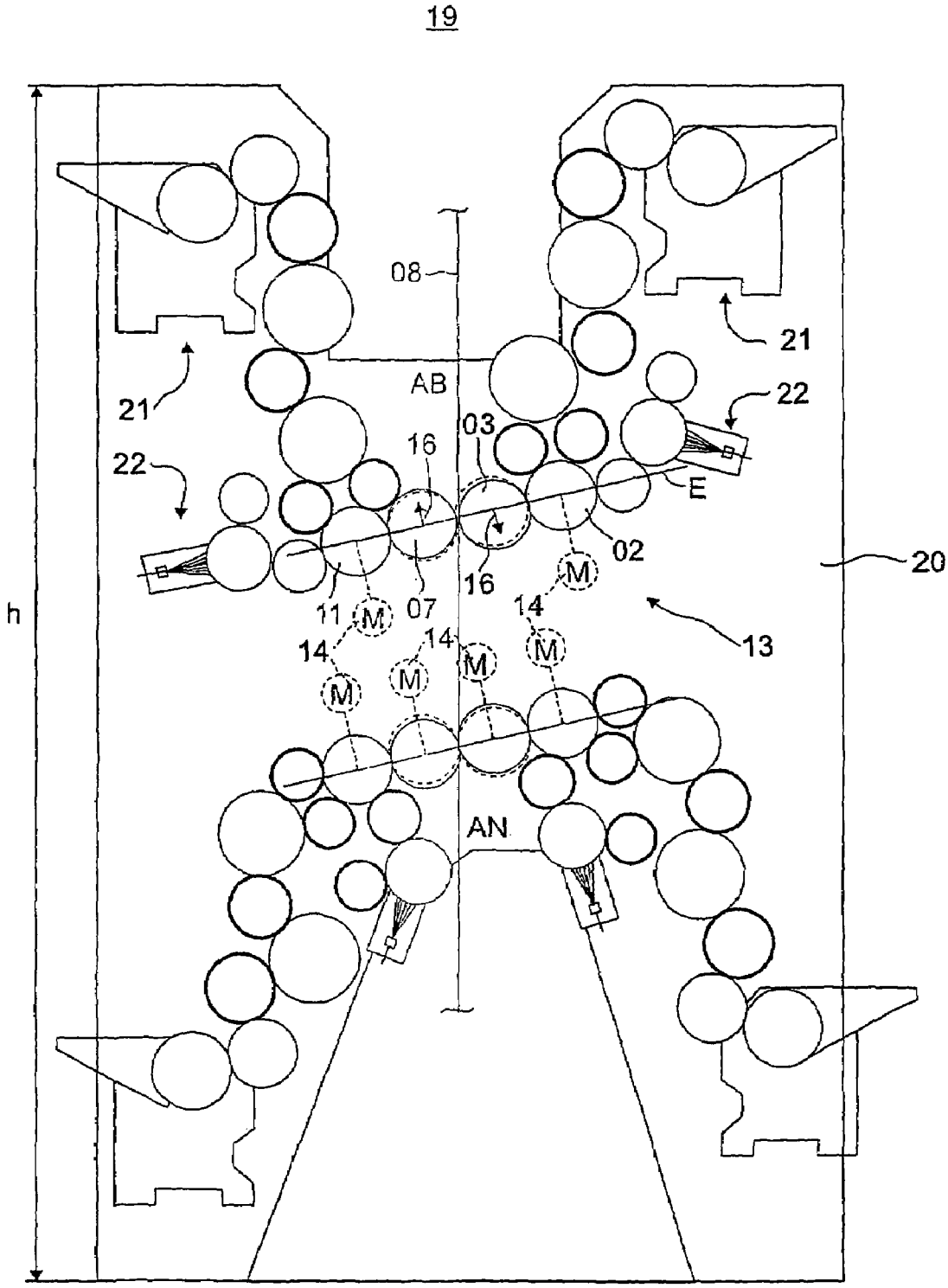

As represented schematically in FIGS. 5, 6 and 7, the transfer cylinders 03, 07 can be movable along a linear actuating path 16. The direction of each actuating path 16, as well as the transfer cylinders 03, 07 in a print-off position AB, are represented in dashed lines in FIGS. 5, 6. The linear actuating paths 16 are shown in solid lines in FIG. 7.

The linear actuating path 16 is accomplished with the aid of linear guide devices, which are not represented in FIG. 5, and which are arranged in or on the lateral frame, that is also not represented in FIG. 5. Seating in a linear guide device is provided for a rugged and low-oscillation construction, preferably on the side I and the side II of the double printing group 13.

In a variation, the actuating path 16, which is linear at least in the area of the nip position, can be formed by seating the transfer cylinders 03, 07 in eccentric bushings, and in particular in double eccentric bushing, which are not specifically represented. It is possible, by the use of such double eccentric bushings, to provide a substantially linear actuating path 16 in the area of the print-on position AN, and, in an area remote from the printing position 09, to provide a curved actuating path 17, if required, which permits a faster or greater movement out of contact of the transfer cylinders 03, 07 than from the cooperating transfer cylinder 07, 03 that from the assigned forme cylinders 02, 11, or vice versa. Seating on side I and on side II of the double printing group 13 is also advantageous for the employment of eccentric cams.

The course of the web 08 through the printing position 09, which is in the print-on position AN, is also represented in FIGS. 5 and 6. The plane E of the double printing group 13, shown in FIG. 5, or of the respective printing group 01, 12 shown in FIG. 6, and the plane of the web 08 intersect in an advantageous embodiment at an angle $\alpha$ of 70° to 85°. If the transfer cylinders 03, 07 have a circumference approximately corresponding to the length of one newspaper page, the angle $\alpha$ is approximately 75° to 80°, preferably approximately 77°, but if the transfer cylinders 03, 07 have a circumference approximately corresponding to two newspaper pages, the angle $\alpha$ is approximately 80 to 85°, preferably approximately 83°. For one, this selection of the angle $\alpha$ takes into account the assured and rapid access to the web 08 and/or the moving apart from each other of the transfer cylinders 03, 07 over a minimized actuating path 16, and also minimizes negative effects, such as mackling or smearing, on the result of printing, which are decisively affected by the amount of a partial looping of the web about the transfer cylinder(s) 03, 07. In an optimal arrangement, the required linear actuating path 16 of each transfer cylinder 03, 07 is less than or equal to 20 mm for bringing the transfer cylinders 03, 07 into and out of contact with each other, but up to 35 mm for affording free access to the web 08 during imprint operations.

When arranging the rotating shafts R02, R03, R07 of the forme, transfer and counter-pressure cylinders 02, 03, 07 in the plane E, as seen in FIG. 5, the direction of the linear actuating path 16 forms an angle $\Delta$ with the plane E, which here coincides with the plane D, which essentially is 90°. The direction of the linear actuating path 16 forms an angle $\gamma$ with a plane of the incoming or outgoing web 08 in the area of an obtuse angle $\beta$ between the web 08 and the plane E. In case of a straight course of the web 08, $\beta=180°-\alpha$ applies, wherein $\gamma$ lies around 5 to 20°, in particular around 7 to 13°. In that case, with a linear printing group 01 and straight-running web 08, the obtuse angle $\beta$ preferably lies between 95° and 110°.

In the case where only one of the forme cylinders and the associated transfer cylinders 02, 03, 11, 07 define the plane E in the contact position, as seen in FIG. 6, the angle $\gamma$ between the actuating path 16 and the plane of the web 08 preferably should be selected to be greater than or equal to 5°, preferably between 5° and 30°, and in particular between 5° and 20°. In particular, for forme cylinders 02, 03, 07, 11 of single circumference, the angle $\gamma$ is greater than or equal to 10°. However, the angle $\gamma$ is upwardly limited in such a way that the angle $\gamma$ between the portion of the plane E pointing in the direction toward the forme cylinders 02, 11 and the direction of the contact-release path 16 is at least 90°. The rapid and dependable removal of the transfer cylinders 03, 07 simultaneously from the web 08 and the associated forme cylinders 02, 11 is assured in this way.

The relationships mentioned are to be correspondingly applied to a "non-linear" course of the web 08, taking into consideration the respective obtuse angle between the web 08 and the plane E.

The direction of the actuating path 16, in the direction toward contact release is selected, regardless of the relative course of the web 08, in such a way, that an angle $\phi$ between the plane E and the actuating path 16 in the direction toward contact release lies by at least 90° and at most 120°, in particular between 90° and 115°. However, the angle $\phi$ is again upwardly limited in such a way that the angle $\Delta$ is at least 90°.

At least one of the transfer cylinders 03, 07 can be advantageously brought out of contact sufficiently far so that, during printing operations, the drawn-in web 08 can be moved through the printing position 09 without touching it.

The double printing group 13 can be multiply employed, for example twice, as represented in FIG. 7, in a printing unit 19, for example a so-called H-printing unit 19, in a common lateral frame 20. In FIG. 7, a separate identification of the respective parts of the lower located double printing group 13, which parts are identical to those in the upper double printing group 13, is omitted. With an arrangement of all cylinders 02, 03, 07, 11 whose circumference substantially corresponds to the length of a newspaper page, it is possible to save structural space, i.e. a height "h" of the printing unit 19. This, of course, also applies to individual printing groups 01, 12 for double printing groups 13, as well as for otherwise configured printing units having several printing groups 01, 12. However, a priority can also be an improved accessibility of the cylinders 02, 03, 07, 11, for example for changing dressings, for cleaning work and washing, and for maintenance and the like, in place of for accomplishing a savings in height "h".

The print-on, or print-off positions AN, AB have been drawn bold in all drawing figures for the purpose of clarity. In FIG. 7, the transfer cylinders 03, 07 are indicated in dashed lines in a second possible position along the linear actuating path 16, wherein here, for example, the upper double printing group 13 is operated in the print-off AB position, shown in solid lines, for example for a printing forme change, and the lower double printing group 13 is operated in the print-on position AN, shown in solid lines, for example for continued printing.

In an advantageous embodiment, each one of the printing groups 01, 12 has at least one drive motor 14 of its own, which is only indicated in dashed lines in FIG. 7, for the rotatory driving of the cylinders 02, 03, 07, 11.

In a schematically represented embodiment, shown at the top in FIG. 7, this can be a single drive motor 14 for the respective printing group 01, 12 which, in an advantageous embodiment, in this case initially drives the forme cylinders 02, 11, and power is transferred from there via a mechanical drive connection, for example spur wheels, toothed belts, etc., to the transfer cylinders 03, 07. However, for reasons of space and for reasons of the flow of torque or moments, it can also be of advantage to transfer power from the drive motor 14 to the transfer cylinders 03, 07, and from there to the forme cylinders 02, 11.

In an alternate embodiment, each printing group 01, 12 has one separate drive motor 14 for each cylinder 02, 03, 07, 11, as shown in FIG. 7 bottom, which motor 14 is mechanically independent of the remaining drive mechanisms and has a large degree of flexibility in the various operating situations, such as production runs, registration, dressing changes, washing, web draw-in, etc.

For special requirements, for example for only one-sided imprinter operations, or merely for the requirement for changing the relative angle of rotation position of the forme cylinders 02, 11 in relation to each other, driving is also possible wherein one of the forme cylinders 02, 11 of a printing group 01, 12 has its own drive motor 14, and the remaining cylinders 02, 03, 07, 11 of the printing group 01, 12 have a common drive motor 14.

The type of drive mechanism in FIG. 7, in the top and bottom is represented by way of example and can therefore be transferred to every other example.

In an advantageous embodiment, driving by use of the drive motor 14 takes place coaxially between the rotating shafts R02, R03, R07, R11 and the motor shaft, if required with a coupling for compensating for angles and/or offset, which will be explained in greater detail below. However, it can also take place via a pinion, in case the "moving along" of the motor 14, or a flexible coupling between the drive motor 14 and the cylinders 02, 03, 07, 11, which are to be moved when required, is to be avoided.

If a drive motor 14 driving the transfer cylinder 03, 07 is to be taken along in the course of the actuating movement, in a further development it can also be taken along on an appropriate guide device on the outside of the lateral frame 20, for example.

In a further development of the preferred embodiments, it is advantageous if an inking system 21 assigned to the respective forme cylinders 02, 11 and, if provided, an associated dampening unit 22, is rotationally driven by a drive motor which is independent of the drive mechanism of the printing group cylinders. In particular, the inking system 21 and the possibly provided dampening system 22 can each have their own drive motors. In the case of an anilox inking system 21, the screen roller, and in connection with a roller inking system 21, for example, the friction cylinder or cylinders, can be rotationally driven individually or in groups. Also, the friction cylinder or cylinders of a dampening system 22 can also be rotationally driven individually or in groups.

Figure 8:
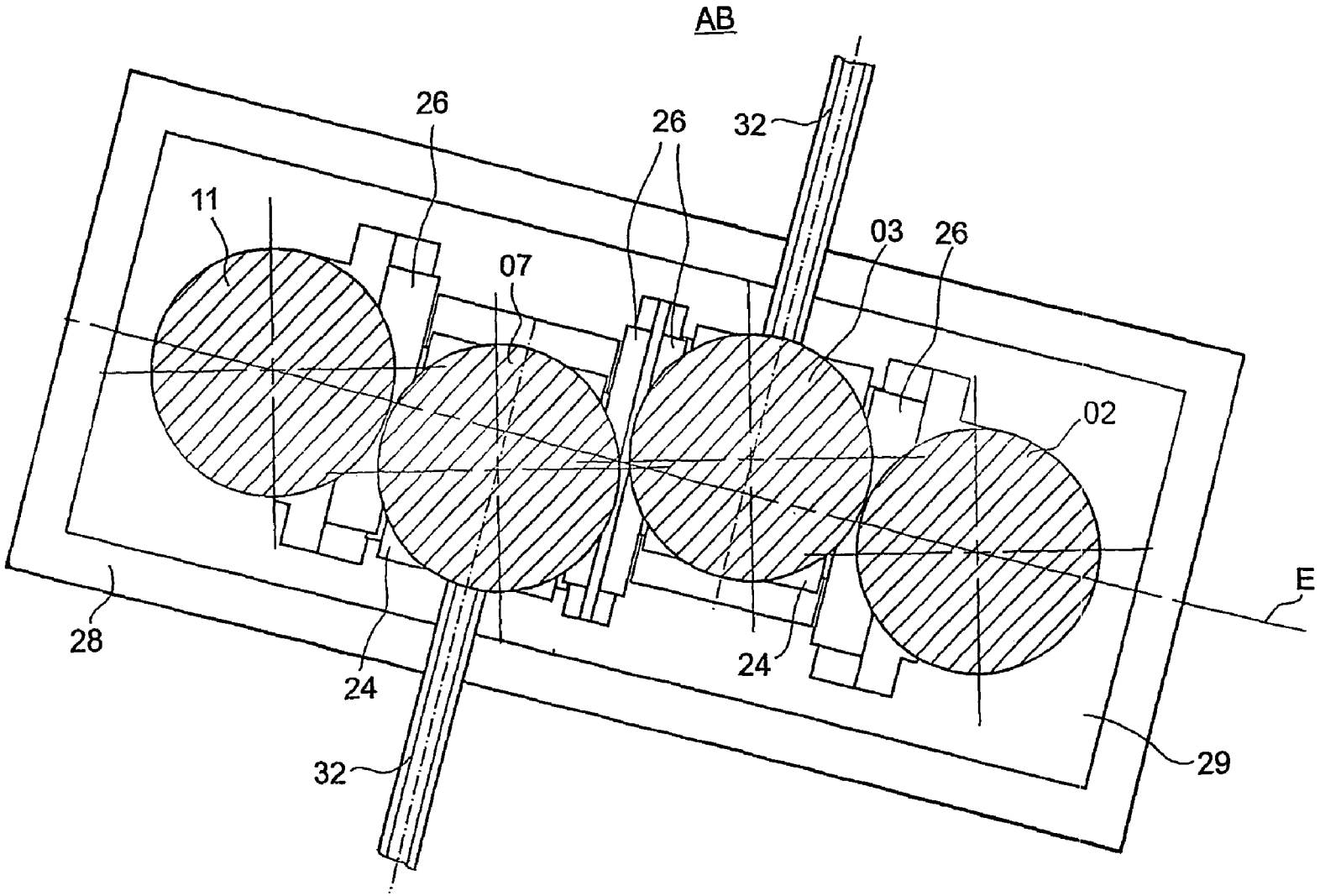
Figure 9:
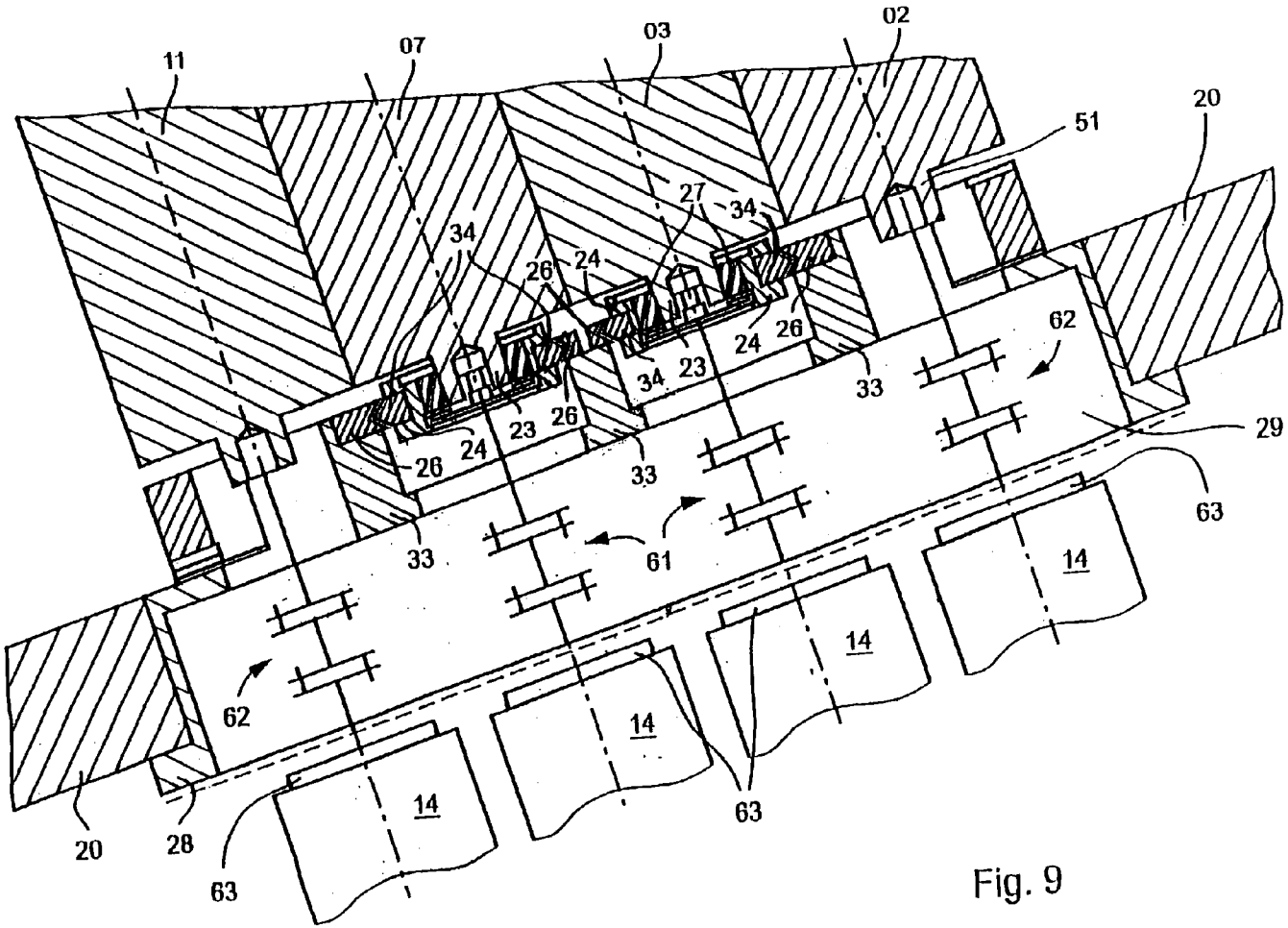

A first preferred embodiment for providing the linear actuating path 16 by the use of a linear guide device is represented in FIGS. 8 and 9.

The journals 23 of at least one of the transfer cylinders 03, 07 are rotatably seated in radial bearings 27 which are, for example, bearing housings 24 that are embodied as carriages 24. In in FIGS. 8 and 9, only the arrangement in the area of the front faces of the cylinders 02, 03, 07, 11 is represented. The bearing housings 24, or carriages 24, are movable in linear guide devices 26, which are connected with the lateral frame 27.

For the linear arrangement of the double printing group 13, the linear guide devices are oriented in an advantageous embodiment almost perpendicularly in respect to the plane E, or D, i.e. $\Delta=90°$, see FIG. 5. In a preferred embodiment, two linear guide devices 26, which extend parallel with each other, are provided for guiding each bearing housing 24, or carriage 24. The linear guide devices 26 of two adjacent transfer cylinders 03, 07 also preferably extend parallel with each other.

In an embodiment which is not specifically represented, the linear guide devices 26 can be arranged directly on the walls of the lateral frame 27, and in particular on walls of openings in the lateral frame 27 which extend almost perpendicularly to the front faces of the cylinders 02, 03, 07, 11.

In the preferred embodiment in accordance with FIGS. 8 and 9, the lateral frame 27 has an insert 28, for example a so-called bell 28, in an opening. The linear guide devices 26 are arranged on, or in this bell 28.

In an advantageous embodiment, the bell 28 has an area which projects in the direction toward the cylinders 02, 03, 07, 11 out of the aligned lateral frame 27. The linear guide devices 26 are arranged in, or on this area of the bell 28.

The distance between the two oppositely-located lateral frames 20, only one of which is represented is, as a rule, set in accordance with the widest unit, for example the wider inking system 21 and, as a rule, leads to a correspondingly longer journal of the cylinders 02, 03, 07, 11. With the above mentioned arrangement, it is advantageous that it is possible to keep the journals of the cylinders 02, 03, 07, 11 as short as possible.

In a further development, the bell 28 has a hollow chamber 29, which is, at least partially arranged at the height of the alignment of the lateral frame 20. As schematically represented in FIG. 9, the rotatory drive mechanisms of the cylinders 02, 03, 07, 11 are connected with the journals of the cylinders 02, 03, 07, 11 in this hollow chamber 29.

With paired driving of the cylinders 02, 03, 07, 11, see below in connection with FIGS. 10 and 11, drive connections, such as cooperating drive wheels 30, for example, can be particularly advantageously housed in this hollow chamber 29. In an advantageous embodiment shown in FIG. 9, with the drive motor 14 fixed in place on the frame, a coupling 61, which compensates for angles and offset, can be arranged on the transfer cylinders 03, 07 between the transfer cylinders 03, 07 and the drive motor 14 in order to even out the movements into and out of contact of the transfer cylinders 03, 07. Coupling 61 can be designed to be double-jointed or, in an advantageous embodiment, as an all-metal coupling 61 with two multi-disk packets, which are rotationally rigid, but axially deformable. The all-metal coupling 61 can even out the offset and the positional change caused by this at the same time. It is important that the rotatory movement is transmitted without play.

In case of the coaxial driving of the forme cylinders 02, 11 in particular, the drive mechanism of the forme cylinders 02, 11 has a coupling 62 between the journal 51 and the drive motor 14, which takes up at least an axial relative movement between the cylinders 02, 11 and the drive motor 14 for setting the lateral register. In order to also take up production tolerances and possibly required movements of the forme cylinders 02, 11 for adjusting purposes, the coupling 62 is designed as a coupling 62 which evens out at least small angles and offsets. It is also designed, in an advantageous embodiment, as an all-metal coupling 62 with two multi-disk packets, which are rotationally rigid, but which are axially deformable. The linear movement is taken up by the multi-disk packets, which are positively connected in the axial direction with the journal 51, or with a shaft of the drive motor 14.

If lubrication, for example a lubricant or oil chamber, is required, the hollow chamber 29 can be bordered in a simple manner by the use of a cover 31, shown in dashed lines, without it increasing the width of the press, or protruding from the frame 20. In that case the hollow chamber 29 can be designed to be encapsulated.

Thus, the arrangement of the bell 28 shortens the lengths of the journals, which has a reduction of oscillations as a result, and makes possible a simple and variable construction, which is suitable for the most varied driving configurations and, along with a large degree of structural uniformity, allows the changing between configurations, with or without drive connections, with or without lubricants, with or without additional couplings.

In the embodiment schematically represented in FIG. 8, driving of the respective bearing housings 24, or carriages 24 in the linear guide devices 26 is performed, for example, by the use of linear drives 32, for example by respective threaded drives 32, for example a threaded spindle driven by an electric motor, not represented. In this case, the rotary position of the electric motor can be controllable. For limiting the travel in the print-on position AN, a stop which is fixed in place on the frame but which is adjustable, can be provided for the bearing housing 24.

However, driving of the bearing housing 24 can also take place by use of a lever mechanism. The latter can also be driven by an electric motor, or by a cylinder which can be charged with a pressure medium. If the lever mechanism is driven by means of one or by several cylinders, which can be charged with a pressure medium, the arrangement of a synchronizing spindle which synchronizes the actuating movements on both sides I and II is advantageous.

The attachment of the transfer cylinders to be moved to the lateral frame 20, or to the bell 28, is provided as follows in the preferred embodiment in accordance with FIG. 9: the bell 28 has support walls 33 on both sides of the carriage 24 to be guided, which receive one of the two corresponding parts of the linear guide device 26. This part can possibly also already be a component of the support wall 33, or can be worked into it. The other corresponding part of the linear guide 26 is arranged on the carriage 24, or has been worked into it, or has it. In an advantageous embodiment, the carriage 24 is guided by two such linear guide devices 26, which are arranged on opposite sides of the carriage 24.

The parts of the guide devices 26 arranged on the support walls 33, or without a bell 28 directly on the lateral frame 20 in this way enclose the carriage 24 arranged between them. The active surface of the parts of the linear guide device 26 connected with the lateral frame 20, or the bell 28, point into the half space facing the journal 23. For reducing the friction between the parts of the guide devices 26 which work together, bearings 34 are arranged in an advantageous embodiment, for example, linear bearings 34, and in particular rolling bearing cages 34, which make possible a linear movement, are provided.

In the ideal case, the respective two parts of the two guide devices 26 permit a movement of the carriage 24 only in one degree of freedom in the form of a linear movement. For this purpose, the entire arrangement is clamped together essentially free of play in a direction extending perpendicularly in respect to the rotating shafts R03, R07 and perpendicularly in respect to the movement direction of the carriage 24. For example, the respective part of the guide device close to the forme cylinder, shown in FIG. 9 with larger dimensions has a clamping device, which is not specifically represented.

The carriage 24 seated in the described manner has the radial bearing 27, which receives the journal 23, for example on a radially inward directed side of a recess facing the transfer cylinders 03, 07.

Figure 10:
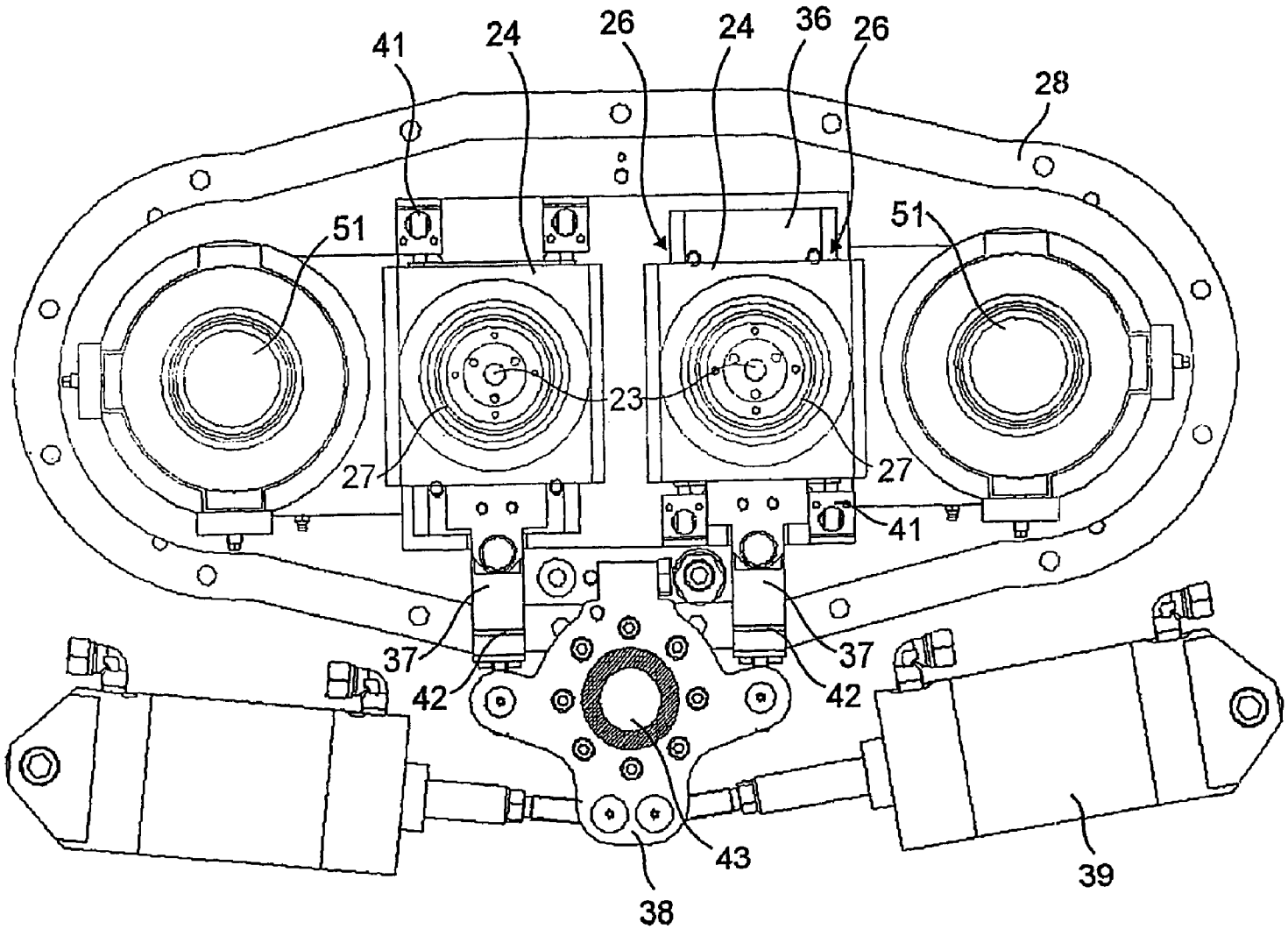
Figure 11:
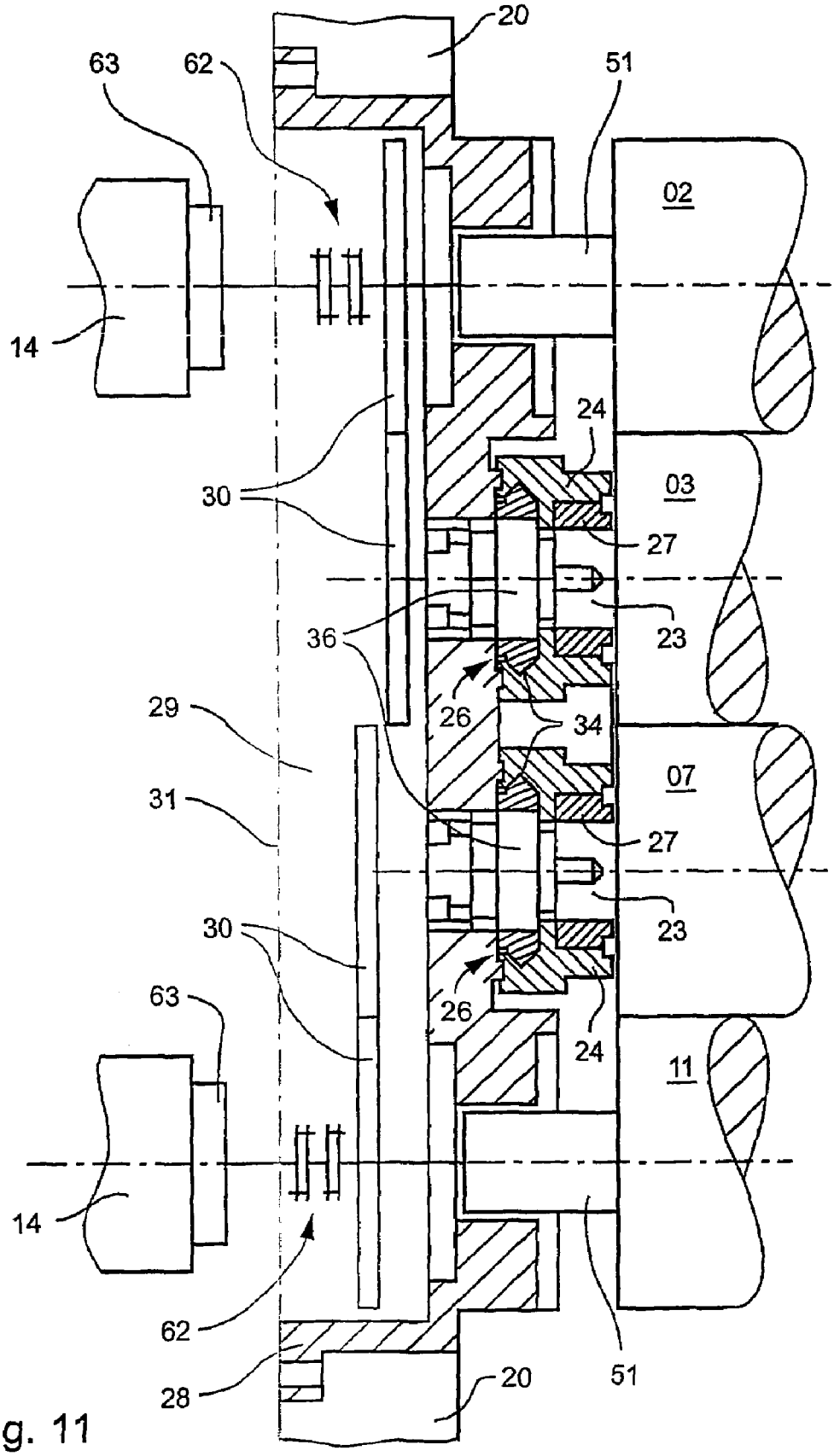

In a second preferred embodiment, as shown in FIGS. 10 and 11, which is advantageous in particular with respect to structural space and to a rugged construction, the active surfaces of the parts of the linear guide device 26, which are connected with the lateral frame 20, or with the bell 28, point into the half space facing away from the journal 23. For this purpose, the parts of the linear guide device are arranged on a support 36 connected with the bell 28 or with the lateral frame 20. The carriage 24 has the parts of the linear guide device 26 which are assigned to it in a recess facing the lateral frame 20, or the bell 28. These parts can be arranged in the recess of the component, or can be already worked into an inward directed surface of the recess of the carriage 24. As in the preferred embodiment in accordance with FIG. 9, the carriage 24 has a recess pointing toward the transfer cylinders 03, 07, in which the radial bearing 27 for receiving the journal 23 is arranged. In the present preferred embodiment, a bearing face for rolling elements of the radial bearing 27 embodied as a rolling bearing 27 has already been worked into an inward directed face of the recess.

Thus, the parts of the guide device 26 arranged on the carriage 24 comprise the support 36, or the parts of the guide devices 26 arranged on the support 36, on the lateral frame 20, or on the bell 28.

In an advantageous embodiment, at least one of the supports 36 assigned to the transfer cylinders 03, 06 has an elongated hole, which is not visible in the drawing figures, and which is matched to the movement direction of the carriage 24, for passing the journal 36 through, which is to be linearly moved. This elongated hole is aligned, at least in part, with an elongated hole, also not visible, which is arranged in the bell 28, or in the associated lateral frame 20. The journal 23, or a shaft connected with the journal 23, passes through these elongated holes, and is in a driven connection with a drive wheel 30, as seen in FIG. 9 or with the drive motor 14 for the rotatory driving of the transfer cylinders 03, 07.

The embodiment in accordance with FIGS. 10 and 11 is advantageous in particular in view of a compact and rugged construction.

Driving of the carriage 24 can take place in a manner already described in connection with the first preferred embodiment. FIG. 11 shows the embodiment by use of an actuating device embodied as a lever mechanism. The carriage 24 is hingedly connected, via a connector 37, with a lever 38, which lever 38 can be pivoted around an axis which extends substantially parallel with the rotating shafts R03, R07 of the transfer cylinders 03, 07. In the preferred embodiment, the connectors 37 of the two adjoining carriages 24 of the cooperating transfer cylinders 03, 07 are hingedly connected with the lever 38, here embodied as a three-armed lever 38, for the purpose of synchronizing the actuating movements of both transfer cylinders 03, 07.

Driving of the lever 38 is performed by the use of at least one actuating drive 39, for example by use of one, or by use of two, as in FIG. 10 cylinders 39, which can be charged with a pressure medium. In the course of actuating the actuating drive 39 and pivoting of the lever 38 in one direction, here in a clockwise direction, the rotating shafts of the two transfer cylinders 03, 07 are moved into the plane E, wherein they are simultaneously placed against each other and against the respective forme cylinders 02, 11. By pivoting in the other direction, the two transfer cylinders 03, 07 are brought out of contact with each other and with the associated forme cylinders 02, 11.

In particular in the case wherein the actuating drive 39 is embodied as a cylinder 39 which can be charged with a pressure medium, the arrangement of stops 41 is advantageous, against which stops 41 the respective carriage 24 is placed in the print-on position AN. These stops 41 have been configured to be adjustable in order to make possible the setting of the end position of the transfer cylinders 03, 07, in which the rotating shafts R03, R07 come to lie in the plane E. The system becomes very rigid if the carriage 24 is pushed with a large force against the stop 41, or respectively the two stops 41 shown in FIG. 10.

If, as in the present case, the carriages 24 of the two adjoining transfer cylinders 03, 07 are actuated by a common actuating device, it is advantageous, in a further development of the preferred embodiments, if the actuating device between the respective carriages 24 and the first common part of the actuating device are embodied to be resilient, at least within narrow limits. To this end, each connector 37 has a multi-disk packet 42, for example a plate spring packet 42, in the manner of a shock-absorbing leg. While in the print-on position AN, the spring packet 42 of the one transfer cylinder 03, 07 is compressed, the spring packet 42 assigned to the other transfer cylinder 07, 03 is under tensile strain.

For synchronizing the linear movement of both sides of the transfer cylinders 03, 07, a shaft 43, for example a synchronized shaft 43, is connected with the actuating device arranged on both sides of the transfer cylinders 03, 07. For this purpose, the shaft 43 in the example is connected, fixed against relative rotation, with the two levers 38 which are respectively arranged on a lateral frame 20 on the sides I and II. In this case, this represents the pivot axis for the levers 38 at the same time.

An adjusting device can be provided in the preferred embodiments in FIGS. 8 to 11, which adjusting device makes possible the basic setting of the spacings between the rotating shafts R02, R03, R07, R11, in particular during assembly and/or if the configurations and/or conditions have changed. For this purpose, individual ones of the cylinders 02, 03, 07, 11, for example the forme cylinder 02, 11, can be seated in an eccentric bushing, if desired. At least one of the transfer cylinders 03, 07 can also be adjustable in a radial direction for this adjustment. For example, the parts of the linear guide device 26 assigned to the lateral frame 20, or to the bell 28, or those of the support 38, can be connected with the lateral frame 20, or the bell 28, through elongated holes which are sufficient for adjusting purposes. An eccentric position, which can be fixed in place, of the radial bearings 27 in the carriage 24 is also possible.

By utilization of the measures explained in the preferred embodiments, it is possible to construct, or to operate a printing group 01, 12 with long, slim cylinders 02, 03, 07, 11, which have the above mentioned ratio of diameter to length of approximately 0,008 to 0.16, in a rugged and low-oscillation manner, while at the same time requiring little outlay regarding space, operation and frame construction. This applies, in particular, to forme cylinders 02, 11 of "single circumference", i.e. with one newspaper page at the circumference, but of double width, i.e. with four newspaper pages on the length of the cylinders 02, 03, 07, 11.

In the preferred embodiments in FIGS. 8, 9, and in FIGS. 8, 11, the cylinders 02, 03, 07, 11, can be driven as described above in pairs of individually driven cylinders, each by its own drive motor 14. In both cases the drive motors 14 are preferably arranged fixed in place on the frame.

In FIG. 11, the four cylinders 02, 03, 07, 11 are rotatingly driven in pairs by a drive motor 14. The drive wheels 30, each constituting a gear, between the forme cylinders 02, 11 and the respectively assigned transfer cylinders 03, 07 each constitute a driven connection together with the drive motor 14. In the case where a bell 28 is used, the gears between the forme and the transfer cylinders 02, 03, 07, 11 can be arranged in a hollow chamber 29 and encapsulated toward the outside as a lubricating chamber.

Driving in pairs takes place from the forme cylinders 02, 11 to the transfer cylinder 03, 07. Depending on the requirements, driving can also take place from the two transfer cylinders 03, 07 to the two forme cylinders 02, 11. The two pairs of drive wheels 30 are preferably arranged in such a way, in relation to each other, that they are out of engagement, which for example takes place by an axially offset arrangement, i.e. on two driving levels.

In the case of cylinders 02, 03, 07, 11 being driven in pairs from the transfer cylinders 03, 07, a coupling 61, which compensates for angles and offset, can be arranged as is shown in FIG. 9.

In the case of the paired driving of the cylinders 02, 03, 07, 11 respectively coaxially at the forme cylinders 02, 11, as represented in FIG. 11, in an advantageous embodiment, the drive mechanism of the forme cylinders 02, 11 has the coupling 62 between the journal 51 and the drive motor 14, in an arrangement which was described in connection with FIG. 9 and which, for setting the lateral register, absorbs at least an axial relative movement between the cylinders 01, 11 and the drive motor 14 and, if required, also absorbs angles and offset.

If the forme cylinders 02, 11 from FIG. 9 or FIG. 11 are not driven coaxially, but for example are driven via a pinion, by a drive motor 14 which is fixed in place on the frame, the embodiment of at least a pair of members, which work together in the drive connection between the drive motor 14 and the forme cylinders 02, 11, with spur toothing and which are adapted to be axially movable in relation to each other, should be provided in order to assure the axial movement of the forme cylinders 02, 11 without their being twisted at the same time. The drive situations respectively represented in FIGS. 9 and 11 could be alternatingly transferred to the two represented embodiments for providing the linear movement.

In an advantageous further development, a gear 63 is arranged between each one of the drive motors 14 and the cylinders 02, 03, 07, 11 to be driven. This gear 63 can be an attached gear 63 connected with the drive motor 14, for example it can be a planetary gear 63. However, it can also be a reduction gear 63 embodied in another way, for example with a pinion or a belt and a drive wheel. The individual encapsulation of each gear 63 is advantageous, for example as an individually encapsulated attached gear 63. The lubricant chambers created in this way are spatially tightly limited and prevent the soiling of adjacent press elements and also contribute to an increase in the quality of the printed product.

In the case of the paired drive of the cylinders 02, 03, 07, 11 schematically indicated in the lower double printing group 13 in FIG. 6, driving takes place on the forme cylinder 02, 11—for example via the attached gear 63 or from a pinion to a drive wheel of the forme cylinder 02, 11. Here, the embodiment of the drive wheels 30, which work together between the forme and transfer cylinders 02, 03, 07, 11, each with spur toothing can be advantageous. The latter also applies to a possibly arranged pinion between the drive motor 14 and the drive wheel of the forme cylinders 02, 11. The above mentioned individual encapsulation extends, for example, around the paired drive mechanism of two cylinders 02, 03, 07, 11, or, in particular in the case of the above described bell 28, around both pairs. A bell 28 can also be embodied for a pair of two cylinders 02, 03, 07, 11. The latter is advantageous, for example, in accordance with producing modules.

The above mentioned embodiments for driving, as well as for moving, the transfer cylinders 03, 07, and the embodiment of the linear guide device 26 can be applied, in the same way, to printing groups in which the cylinders 02, 03, 07, 11 do not all have the same circumference, or diameter, as shown in FIG. 12. For example, the forme cylinder or cylinders 02, 11 can have a circumference U which has one printed page, for example the longitudinal page of a newspaper, a "single circumference" in what follows. The cooperating transfer cylinders 03, 07 have, for example, a circumference or diameter, which corresponds to a whole number multiple, greater than 1, of that of the forme cylinders 02, 11, i.e. it has a circumference, for example, of two or even three printed pages of newspaper format, or is correspondingly matched to other formats.

If the printing position is constituted by a transfer cylinder 03, 07 and a counter-pressure cylinder 07, 03, embodied as a satellite cylinder 07, 03, the forme and the transfer cylinders 02, 11, 03, 07 can also have a single circumference, and the assigned counter-pressure cylinder 07, 03 can be designed larger by a multiple.

By use of the above-mentioned embodiments, an increased stiffness of the printing groups is also achieved in an advantageous manner. This has a particular advantage in connection with cylinders 02, 03, 07, 11 which have a length which corresponds to at least four, or even six, vertical printed pages, in particular newspaper pages.

In contrast to printing presses with double circumference and single width, the embodiment of the cylinders 02, 03, 07, 11 with double width and—at least the forme cylinders 02, 11—with a "single circumference" makes a considerably greater product variability possible. Although the maximum number of possible printed pages remains the same, in the case of single-width printing groups 01, 12 with double circumference they are in two different "books", or "booklets" in the assembly operation. In the present case, with double-width printing groups 01, 12 of single circumference, the double-width webs 08 are longitudinally cut after having been imprinted. In order to achieve a maximum booklet width, one or several partial webs are conducted one above the other in the so-called folding superstructure, or turning deck, and are folded to form a booklet on a former without assembly operations. If such booklet thicknesses are not required, some partial webs can be guided on top of each other, but others can be conducted together to a second hopper and/or folding apparatus. However, two products of identical thickness can also be conducted without being transferred to two folding apparatus. A variable thickness of two different products is thus provided. If, in case of a double folding apparatus or of two folding apparatus in which at least two product delivery devices are provided, it is possible, depending on the arrangement, to conduct the two booklets, or products, next to or above each other to one side of the printing press, or to two different sides.

The double-width printing press of single circumference has a great variability in particular when staggering the possible page numbers of the product, the co-called "page jump". While the thickness per booklet, or layer in the printing press of double circumference and of single width can only be varied in steps of four printed pages during assembly operation, i.e. with maximum product thickness, the described double-width printing press of single circumference allows a "page jump" of two pages, for example when printing newspapers. The product thickness, and in particular the "distribution" of the printed pages to different books of the total product or the products, is considerably more flexible.

After the web 08 has been longitudinally cut, the partial web is conducted either to a former which is different in respect to the corresponding partial web, or is turned to be aligned with the last mentioned one. This means that, in the second case, the partial web is brought into the correct longitudinal, or cutting register prior to, during or after turning, but before being brought together with the "straight ahead webs". In an advantageous embodiment, this is taken into account as a function of the circumferential direction of grooves 04, 06, which are offset in respect to each other, of a cylinder 02, 03, 07, 11 by the appropriate design of the turning deck, for example preset distances of the bars, or of the path sections. Fine adjustment, or correction, is performed by use of the actuating paths of the cutting register control device of the affected partial web and/or partial web strand, in order to place partial webs on two different running levels on top of each other with the correct registration, when required.

Figure 14:
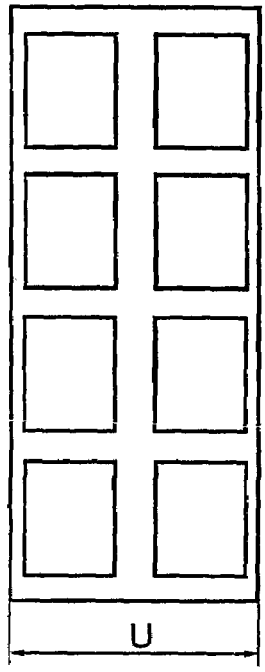
Figure 15:
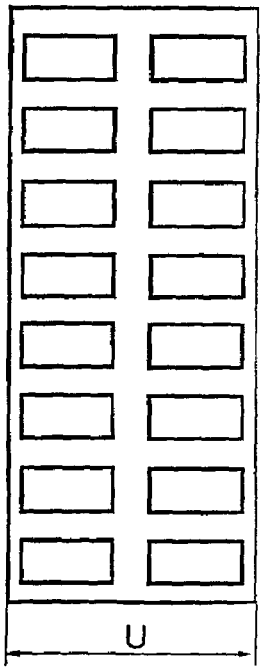
Figure 16:
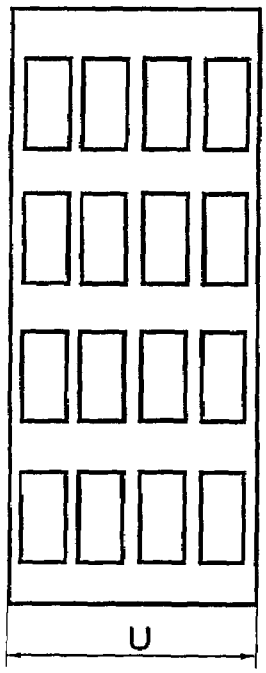

Now, the forme cylinders 02, 11 can be provided, in the circumferential direction, with one vertical printed page in broadsheet format and in the longitudinal direction with at least four, as seen in FIG. 13. Alternatively, these forme cylinders 02, 11 can also be selectively provided with two pages in the circumferential direction and, in the longitudinal direction, with at least four horizontal printed pages in tabloid format, as seen in FIG. 14, or with two pages in the circumferential direction and, in the longitudinal direction, with at least eight vertical printed pages in book format, as seen in FIG. 15, or with four pages in the circumferential direction and in the longitudinal direction with at least four horizontal printed pages in book format, as seen in FIG. 16 by the use of respectively one flexible printing plate which can be arranged in the circumferential direction of the forme cylinder 03, and at least one flexible printing plate arranged in its longitudinal direction.

Thus, depending on the placement on the forme cylinders 02, 11 with horizontal tabloid pages, or with vertical newspaper pages, and in particular with broadsheet pages, or with horizontal or vertical book pages, it is possible by use [means] of the double-width printing press and at least the forme cylinders 02, 11 of single circumference, to produce different products, depending on the width of the web 08 used.

With the double printing group 13, the production, in one stage, of two vertical printed pages arranged on the forme cylinder, a "two page jump" with variable products in broadsheet format, is possible.

With a width of the web 08 corresponding to four, or to three, or to two vertical printed pages, or of one printed page in broadsheet format, the production of a product in broadsheet format consisting of a layer in the above sequence with eight, or six, or four, or two printed pages is possible.

With a web width corresponding to four vertical printed pages in broadsheet format, the double printing group can be used for producing respectively two products in broadsheet format, consisting of one layer with four printed pages in the one product and four printed pages in the other product, or with two printed pages in the one product and with six printed pages in the other product. With a web width corresponding to three vertical printed pages, it is suitable for producing respectively two products in broadsheet format consisting of one layer with four printed pages in the one product and with two printed pages in the other product.

Furthermore, with a web width corresponding to four vertical printed pages in broadsheet format, the double printing groups 13 can be used for the production of a product in broadsheet format consisting of two layers with four printed pages in the one layer and with four printed pages in the other layer, or with two printed pages in the one layer and with six printed pages in the other layer. With a web width corresponding to three vertical printed pages, the double printing group 13 can be used for producing a product in broadsheet format consisting of two layers with four printed papers in the one layer and two printed pages in the other layer.

In the case of printed pages in tabloid format, the double printing group 13 can be used for producing in one stage printed pages arranged horizontally on the forme cylinder 02, 11 with variable products, a "four page jump" in tabloid format. Accordingly, with a web width corresponding to four, or to three, or to two horizontal printed pages, or to one horizontal page, the double printing group 13 can be used for producing a product in tabloid form consisting of one layer in the above sequence with sixteen, or twelve, or eight, or four printed pages.

With a web width corresponding to four horizontal printed pages in tabloid form, the double printing group 13 can be used for producing two products in tabloid format, each consisting of one layer with eight printed pages on the one product and with eight printed pages on the other product, or with four printed pages on the one product and with twelve printed pages on the other product. With a web width corresponding to three horizontal printed pages, the double printing group 13 can be used for producing two products, each consisting of one layer with four printed pages on the one product and with eight printed pages in the other product.

With products in book format, the double printing group 13 can be used for producing, in one stage, eight printing pages with variable, "eight page jump"products arranged vertically on the printing cylinders 02, 11.

With a web width corresponding to eight, or to six, or to four, or to two vertical printed pages, the production of a product in book format consisting of a layer in the above sequence with thirty-two, or twenty-four, or sixteen, or eight printed pages, is possible.

With a web width corresponding to eight vertical printed pages in book format, the double printing group 13 can be used for producing respectively two products in book format, each consisting of one layer, with sixteen printed pages on the one product and with sixteen printed pages on the other product, or with twenty-four printed pages on the one product and with eight printed pages on the other product. With a web width corresponding to six vertical printed pages in book format, the double printing group 13 can be used for producing respectively two products in book format, each consisting of one layer, with sixteen printed pages on the one product and with eight printed pages on the other product.

For products in book format, the double printing group 13 is furthermore usable for producing, in one stage, eight printed pages arranged vertically with variable products, "eight page jump" on the forme cylinder 03 (double transverse fold).

With a web width corresponding to four, or to three, or to two horizontal printed products, or to one horizontal printed page in book format, the double printing group 13 can be used for producing a product in book format consisting of a layer in the above sequence with thirty-two, or with twenty-four, or with sixteen, or with eight printed pages.

With a web width corresponding to four horizontal printed pages in book format, the double printing group 13 can be used for producing respectively two products in book format, each consisting of a layer, with sixteen printed pages on the one product and with sixteen printed pages on the other product, or with twenty-four printed pages on the one product and with eight printed pages on the other product. With a web width corresponding to three horizontal printed pages in book format, the double printing group 13 can be used for producing respectively two products in book format, each consisting of a layer, with sixteen printed pages on the one product and with eight printed pages on the other product.

If the two partial web strands are longitudinally folded on different hoppers and thereafter conducted to a common folding apparatus, what was said above should be applied to the distribution of the products to different folded booklets, or layers, of the described variable number of pages.

While preferred embodiments of a printing group pertaining to a printing machine having a linearly displaceable transfer cylinder in accordance with the present invention have been set forth fully and completely hereinabove, it will be apparent to one of skill in the art that various changes in for example the type of web being printed, the specific structure of the blankets or dressings secured to the cylinders, the specific cylinder clamping devices and the like could be made without departing from the true spirit and scope of the present invention which is accordingly to be limited only by the following claims.

What is claimed is:

1. A printing group of a printing press comprising:

a forme cylinder having forme cylinder journals;

a transfer cylinder having transfer cylinder journals, said transfer cylinder being engageable with said forme cylinder;

a counter-pressure cylinder having counter-pressure cylinder journals, said transfer cylinder being supported by said transfer cylinder journals for movement along a linear actuating path between a print-on position in contact with said counter-pressure cylinder and a print-off position out of contact with said counter-pressure cylinder;

at least a first drive motor adapted to drive at least one of said transfer cylinder and said forme cylinder mechanically independently of said counter-pressure cylinder, said at least first drive motor being fixed in place on a lateral frame of the printing press;

a drive mechanism between said at least first drive motor and said at least one of said forme cylinder and said transfer cylinder, said one of said forme cylinder and said transfer cylinder being coaxially driven by said at least first drive motor through said drive mechanism, said drive mechanism including a coupling between said journal of one of said forme cylinder and said transfer cylinder and said at least first drive motor, said coupling being adapted to absorb axial relative movement between said journal of said one of said forme cylinder and said transfer cylinder and said at least first drive motor, said coupling also being adapted to compensate for at least slight angles and offsets;

radial bearings receiving each of said transfer cylinder journals and said counter-pressure cylinder journals;

a separate bearing housing receiving said radial bearings of each of said transfer cylinder and said counter-pressure cylinder, each said separate bearing housing supporting its one of said transfer cylinder radial bearings and said counter-pressure cylinder radial bearings for movement of said one of said transfer cylinder and said counter-pressure cylinder along said linear actuating path with respect to the other of said transfer cylinder and said counter-pressure cylinder; and first and second linear guide devices supporting each said separate bearing housing for movement of each said separate bearing housing, and said radial bearings with respect to said lateral frame of the printing press, said first and second linear guide devices being parallel to each other, and being positioned on interior walls of said lateral frame.

2. The printing group of claim 1 wherein said transfer cylinder can be placed against said forme cylinder and against said counter-pressure cylinder along said linear actuating path.

3. The printing group of claim 1 wherein a plane is defined by said journals of said transfer cylinder and said forme cylinder in said print-on position and wherein said linear actuating path deviates from said plane.

4. The printing group of claim 3 wherein said plane intersects a web plane of a web entering and leaving said printing group at an obtuse angle.

5. The printing group of claim 4 further including a first angle between said linear actuating path and said web plane, said first angle being at least 5° and wherein a second angle between said linear actuating path and said common plane pointing in a direction toward said forme cylinder is at least 90°

6. The printing group of claim 4 wherein said obtuse angle is between 95° and 110°.

7. The printing group of claim 1 wherein said drive motor is located at said forme cylinder.

8. The printing group of claim 1 wherein said drive motor is located at said transfer cylinder.

9. The printing group of claim 1 further including a separate drive motor for each of said forme cylinder and said transfer cylinder.

10. The printing couple of claim 7 wherein a drive connection between said forme cylinder and its associated drive motor is adapted to absorb relative motion between said forme cylinder and said drive motor.

11. The printing couple of claim 9 wherein a drive connection between said forme cylinder and its associated drive motor is adapted to absorb relative motion between said forme cylinder and said drive motor.

12. The printing group of claim 2 wherein at least two of said cylinders each have at least one axially extending interruption on a cylinder active jacket surface, said interruptions being arranged to alternatingly roll off on each other.

13. The printing group of claim 2 wherein at least two of said cylinders each have at least two axially extending interruptions on a cylinder active jacket surface, said interruptions on each said cylinder being arranged next to each other in a longitudinal direction of each said cylinder and offset from each other in a circumferential direction of said cylinder.

14. The printing group of claim 2 wherein at least said forme cylinder and said transfer cylinder each have a circumference which corresponds to a section length of printed page.

15. The printing group of claim 2 further including a second forme cylinder and wherein said counter-pressure cylinder is a second transfer cylinder assigned to said second forme cylinder.

16. The printing group of claim 15 wherein said second transfer cylinder is supported for movement along a second linear actuating path.

17. The printing group of claim 1 further including a common insert received in a lateral frame of said printing press, and wherein at least two of said cylinders are seated in said common insert.

18. The printing group of claim 17 wherein said common insert includes an insert area extending out of alignment of said lateral frame toward said cylinders seated in said common insert.

19. The printing group of claim 1 wherein portions of said linear guide devices associated with each said separate bearing housing extend around portions of said linear guide devices which are connected with said lateral frame.

20. The printing group of claim 1 wherein portions of said linear guide devices are connected with said lateral frame and extend around portions of said linear guide devices associated with said bearing housing.

21. The printing group of claim 1 wherein said forme cylinder and said transfer cylinder each has a circumference adapted to print a single page in newspaper format.

22. The printing group of claim 1 wherein said forme cylinder has a circumference which corresponds to a section length of a printed page in newspaper format and said transfer cylinder has a circumference corresponding to a whole number multiple greater than one of said forme cylinder circumference.

23. The printing group of claim 1 wherein each of said cylinders has a length which corresponds to four widths of a newspaper page.

24. The printing group of claim 1 wherein at least two of said cylinders each have at least two interruptions on a cylinder active jacket surface, said at least two interruptions being arranged next to each other in a longitudinal cylinder direction and being offset from each other in a circumferential direction.

25. The printing group of claim 15 wherein at least two of said cylinders each have at least two interruptions on a cylinder active jacket surface, said at least two interruptions being arranged next to each other in a longitudinal cylinder direction and being offset from each other in a circumferential direction.

26. The printing group of claim 24 wherein said interruptions are arranged so that they roll off in pairs on each other.

27. The printing group of claim 25 wherein said interruptions are arranged so that they roll off in pairs on each other.

28. The printing group of claim 12 wherein each of said interruptions is a groove adapted to receive at least one dressing.

29. The printing group of claim 13 wherein each of said interruptions is a groove adapted to receive at least one dressing.

30. The printing group of claim 1 further including linear bearings between said bearing housing and said first and second linear guide devices.

31. The printing group of claim 30 wherein said linear bearings are rolling bearing cages.

32. The printing group of claim 1 further including support walls on said lateral frame, said support walls having portions of said linear guide device, supporting each said separate bearing housing, arranged between them.

33. The printing group of claim 17 further including support walls on said common insert, said support walls having portions of said linear guide device, supporting each said separate bearing housing, arranged between them.

34. The printing group of claim 1 further including support walls on said lateral frame and guide faces on each said separate bearing housing, said support walls supporting said linear guide device, which partially extends around each said separate bearing housing guide faces.

35. The printing group of claim 1 wherein said linear guide device includes two first active areas which are inclined toward each other, and two inclined complementary second active areas assigned to each said separate bearing housing and working with said two first active areas.

36. The printing group of claim 35 wherein each of said two active areas are inclined toward each other in a v-shape.

37. The printing group of claim 35 wherein said inclined active areas counteract a relative movement of said linear guide in an axial direction of each said cylinder.

38. The printing group of claim 1 wherein each said linear guide devices has first and second pairs of cooperating active areas arranged with respect to each other to counteract a relative movement of each said separate bearing housing in an axial direction of said movable cylinder.

39. The printing group of claim 1 wherein each said first and second linear guide devices includes at least two parts adapted to permit movement of said separate bearing housing only in a linear direction.

40. The printing group of claim 1 further including support walls of said lateral frame, each said linear guide devices being arranged on said support walls.

41. The printing group of claim 1 wherein said at least one of said first and second linear guide devices is secured, free of play, in a direction perpendicular to an axis of rotation of said at least one movable cylinder and perpendicular to a direction of movement of each said separate bearing housing.

42. The printing group of claim 41 further including a clamping device adapted to clamp said at least one of said first and second linear guide devices.

43. The printing group of claim 1 further including a separate drive motor for said movable transfer cylinder.

44. The printing group of claim 1 further including a separate drive motor for each of said at least three cylinders, each said separate drive motor being mechanically independent.

45. The printing group of claim 1 further including pairs of said at least three cooperating cylinders, and a separate drive motor for each said pair, each said drive motor being mechanically independent.

46. The printing group of claim 43 wherein said drive motor is arranged coaxially to said journal of said transfer cylinder.

47. The printing group of claim 1 wherein said first and second linear guide devices secured to said lateral frame are arranged projecting out of alignment with said lateral frame.

48. The printing group of claim 1 wherein said first and second parallel linear guide devices include guide portions extending on a side of said lateral frame facing said cylinders and guide portions on each said separate bearing housing, said frame supported guide portions extending around said bearing housing guide portions.

49. The printing group of claim 1 wherein said at least two parallel linear guide devices include guide portions extending on a side of said lateral frames facing said cylinders and guide portions on each said separate bearing housing, said bearing housing guide portions extending around said frame supported guide portions.

50. The printing group of claim 1 wherein a spacing between said first and second linear guide devices supporting each said separate bearing housing is less than a diameter of said cylinder supported by each said separate bearing housing.

* * * * *